US005415979A

United States Patent [19]

Takemura et al.

[11] Patent Number: 5,415,979

[45] Date of Patent: May 16, 1995

[54] STABILIZER COMPOSITION FOR PROCESSING SILVER HALIDE PHOTOGRAPHIC LIGHT-SENSITIVE MATERIAL AND A METHOD OF PROCESSING SILVER HALIDE LIGHT-SENSITIVE MATERIAL USING THE SAME

[75] Inventors: Koji Takemura; Hiroaki Kobayashi, both of Hino, Japan

[73] Assignee: Konica Corporation, Tokyo, Japan

[21] Appl. No.: 278,420

[22] Filed: Jul. 21, 1994

[30] Foreign Application Priority Data

Jul. 28, 1993 [JP] Japan ..... 5-186255

[51] Int. Cl.[6] ..... G03C 7/30

[52] U.S. Cl. ..... 430/372; 430/428; 430/429

[58] Field of Search ..... 430/372, 428, 429

[56] References Cited

U.S. PATENT DOCUMENTS

| | | | |
|---|---|---|---|
| 4,385,110 | 5/1983 | Yoneyama et al. | 430/372 |
| 5,110,716 | 5/1992 | Kuse et al. | 430/428 |
| 5,225,320 | 7/1993 | Kuse et al. | 430/372 |
| 5,362,609 | 11/1994 | Kuwae et al. | 430/372 |

FOREIGN PATENT DOCUMENTS

0537361A1 4/1993 European Pat. Off. .

OTHER PUBLICATIONS

Patent Abstracts of Japan, "Stabilizer for Silver Halide Color Photographic Sensitive Material and Processing Method Using the Stabilizer", P section, vol. 17, No. 112, Mar. 8, 1993, The Patent Office Japanese Government, p. 26 P 14887 of JP-A-04 299 340.

*Primary Examiner*—Hoa Van Le

*Attorney, Agent, or Firm*—Frishauf, Holtz, Goodman & Woodward

[57] ABSTRACT

A composition of stabilizer for processing silver halide photographic material is disclosed. The composition comprises a fluorinated anionic surfactant represented by Formula I;

$$Rf\text{-}(X)_m\text{-}(Y)_n\text{-}A \qquad (I)$$

wherein Rf is an alkyl group having a fluorine atom, an alkenyl group having a fluorine atom or an alkinyl group having a fluorine atom; X is a sulfonamido group, a group or a $$\begin{array}{l} CH_2COOCH_2CH_2\text{—}Rf' \\ | \\ \text{-}(CHCOOCH_2CH_2)\text{-} \end{array}$$

group, in which Rf' is a saturated or unsaturated hydrocarbon group having a fluorine atom; Y is alkyleneoxide or alkylene; A is an —$S_3M$ group, an —$OSO_3M$ group, a —COOM group, an —$OPO_3$ ($M_1$) ($M_2$) group or a —$PO_3$ ($M_1$) ($M_2$) group, in which M, $M_1$ and $M_2$ are each a hydrogen atom, a lithium atom, a potassium atom, a sodium atom or an ammonium group; m is 0 or 1 and n is 0 or an integer of 1 to 10.

16 Claims, 5 Drawing Sheets

COLLECTIVELY PACKAGED TABLETED COMPOSITION

STABILIZER COMPOSITION FOR PROCESSING SILVER HALIDE PHOTOGRAPHIC LIGHT-SENSITIVE MATERIAL AND A METHOD OF PROCESSING SILVER HALIDE LIGHT-SENSITIVE MATERIAL USING THE SAME

FIELD OF THE INVENTION

This invention relates to a stabilizer composition for processing a silver halide photographic light-sensitive material and particularly to a solid stabilizer composition for processing a silver halide photographic light-sensitive material, which improved in social and operational environmental aptitudes and in practical application through the operational simplification.

BACKGROUND OF THE INVENTION

A silver halide photographic light-sensitive material is commonly processed by making use of a black-and-white developer, a fixer, a color developer, a bleacher, a bleach-fixer and a stabilizer, so that an image can be obtained. Each of the processing solutions is concentrated into a single or plural parts and is then put into a plastic-made bottle, for the purpose of simplifying the handling the solutions, so that the solutions are supplied as a kit of the processing chemicals to the users. A user dissolves the above-mentioned processing chemical kit in water to prepare a working solution, a starter solution or a replenishing solution, and then he uses the working solution.

In the field of photographic industry in recent years, a small-scaled photofinishing laboratories at which a small-sized automatic processor is used, that is so-called a Mini-Lab., have been rapidly increased. With the increase in such a mini-labs., the quantities of plastic-made bottles for processing chemical use has also rapidly increased year by year.

The plastics mentioned above have also been used, besides the bottles for photographic processing chemicals, because of its light and strong properties. On the other hand, scrapped plastic pottles cause environmental problems.

Therefore, an urgent countermeasure has been required.

Under the circumstances such as mentioned above, it is really unfavorable to use a large amount of plastic-made bottles of the processing chemicals for photographic use, though the photographic use is merely a part of the whole consumption of the plastics.

In recent years, rapid processing services have been in great demand, and the photographic processing operations are being transferred from mini-labs to the so-called micro-labs (or a smaller-scaled mini-lab.). In the conventional labs., an operator who has handled a processing chemicals there, has had a knowledge of processing chemicals. However, with the transfer of the photographic processing thereto, for example, a smaller-scaled lab is introduced into a convenience store or a drug store, the operations thereof are to be carried out by one without having any knowledge of processing chemicals. Therefore it becomes important to prevent harms to a human body caused by scatter or flying of the chemicals during preparation and handing of processing solutions. Furthermore, it is required to provide processing chemicals which can be prepared to a processing solution without any erroneous dissolution operation if the operation is carried out by unskilled one.

Accordingly, Japanese Patent Publication Open to Public Inspection (hereinafter referred to as JP OPI Publication) Nos. 2-109042/1990, 2-109043/1990 and 3-39735/1991 and U.S. Pat. No. 2,843,484, for example, propose each such a technique that photographic processing chemicals are made in a solid form.

In addition, a technology to solidify a photographic processing composition and to directly charge the photographic processing composition to the automatic processing machine in accordance with an amount of the light-sensitive materials processed is disclosed in Japanese Patent O.P.I. Publication No. 119454/1993. Owing to this technology, it is not necessary for an operator to contact the photographic processing composition directly. Therefore, safety and simplicity in terms of replenishment are improved.

In the case of a stabilizer, a hydrocarbon type nonionic surfactant is ordinarily used for improving surface wettability and preventing water-spot-caused unevenness and stain on the rear surface. This is known in U.S. Pat. No. 3,404,004 and Japanese Patent O.P.I. Publication Nos. 197540/1982 and 36560/1980. However, in these hydrocarbon type nonionic surfactants, melting points are low so that liquid types are ordinarily used. When they are used in a solid processing composition as in the present invention, the solid processing composition is deformed due to storage. Accordingly, the hydrocarbon type nonionic surfactants have been completely unsuitable material for practical use.

As results of further experiments, it has come to be apparent that, in the case that solid or paste hydrocarbon type nonionic surfactants and other hydrocarbon type surfactants are used, the solid processing composition is swollen after aging when stored at high temperature. Increasing in the porosity of the solid stabilizer composition by the swelling accelerates decomposition of components in the composition. In addition, in the case of powder and granule, blocking is caused so that the processing composition cannot be supplied to the processing tank constantly. In the case of a tablet composition, stiffness of tablet composition is lowered so that it cannot bear the shock of dropping. As a result, the tablet composition is broken, causing defective charging.

Therefore, it has been demanded to develop a solid stabilizing composition excellent in terms of preservability without causing water-drop-caused unevenness and stain on the rear surface.

Incidentally, the stabilizing processing solution has the following problem in addition to the above-mentioned problems of a solid processing composition. These hydrocarbon type. nonionic surfactants are highly dependent to temperature. When a stabilizer wherein aforesaid surfactant is used is processed continuously, there may occur cases wherein oil-like floating substances are produced. It turned out that, even when this oil is contained in a small amount, the occurrence of tar is accelerated and scratches due to the floating substances are caused.

When the processing is continued furthermore, a large amount of oil-like floating substances deteriorate the surface wettability of the stabilizing solution so that water-spot-caused unevenness and stain on the rear surface are increased.

From the results obtained through various studies, the present inventors have discovered that some of the anionic type surfactants can satisfy the above-mentioned characteristics having so far been demanded; and when a further study was continued by the inventors, the following facts were proved. Ordinary anionic type surfactants have a strong interaction with calcium ion and magnesium each contained in a dissolving water or dissolved out of a light-sensitive material, so that a light-sensitive material is contaminated by producing a precipitate under some condition, or that a trouble is produced by partly clogging a filter of an automatic processor.

As the results that the present inventors have performed a further detailed study, they discovered that, among the anionic type surfactants, those fluoro-substituted can satisfy the above-mentioned characteristics and can also display the above-mentioned effects excellently.

It was also proved that, when applying a fluorine type anionic surfactant of the invention to a solid stabilizer composition, the effect of displaying the preservability of a solid stabilizer composition can be displayed in the course of preservation.

SUMMARY OF THE INVENTION

It is, accordingly, an object of the invention is to provide a stabilizer composition for processing silver halide photographic light-sensitive material having the following characteristics.

(1) An amount of packaging materials (including, particularly, a plastic-made bottle), can be reduced so as to provide social environmental aptitude;

(2) A stabilizer can be made lighter in weight and the transportation cost thereof can also be saved and, further, the storage space thereof can be saved in every photofinishing laboratory;

(3) The preservation stability thereof can be improved, and any stain production can be eliminated in the course of processing a light-sensitive material and any scratching troubles of a light-sensitive material can also be prevented after completing the processing the light-sensitive material; and (4) the solubility and preservability of a solid stabilizer composition can be improved.

The object of the invention can be achieved by a stabilizer composition for processing silver halide photographic light-sensitive material and a method comprising a step of stabilizing a silver halide photographic material using the composition. The stabilizer composition comprises a fluorinated anionic surfactant represented by Formula I;

$$Rf\text{-}(X)_m\text{-}(Y)_n\text{-}A \qquad (I)$$

wherein Rf is an alkyl group having a fluorine atom, an alkenyl group having a fluorine atom or an alkinyl group having a fluorine atom; X is a sulfonamido group, a

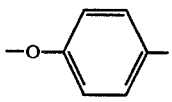

group or a $$\begin{array}{l} CH_2COOCH_2CH_2\text{—}Rf' \\ \quad | \\ \text{-}(CHCOOCH_2CH_2)\text{-} \end{array}$$

group, in which Rf' is a saturated or unsaturated hydrocarbon group having a fluorine atom; Y is an alkyleneoxide group or an alkylene group A is an —$SO_3M$ group, an —$OSO_3M$ group, a —COOM group, an —$OPO_3$ ($M_1$) ($M_2$) group or a —$PO_3$ ($M_1$) ($M_2$) group, in which M, $M_1$ and $M_2$ are each a hydrogen atom, a lithium atom, a potassium atom, a sodium atom or an ammonium group; m is 0 or 1 and n is 0 or an integer of 1 to 10.

The composition is preferably made in a solid form, particularly in a form of granule or tablet.

DETAILED DESCRIPTION OF THE INVENTION

Figure 1:
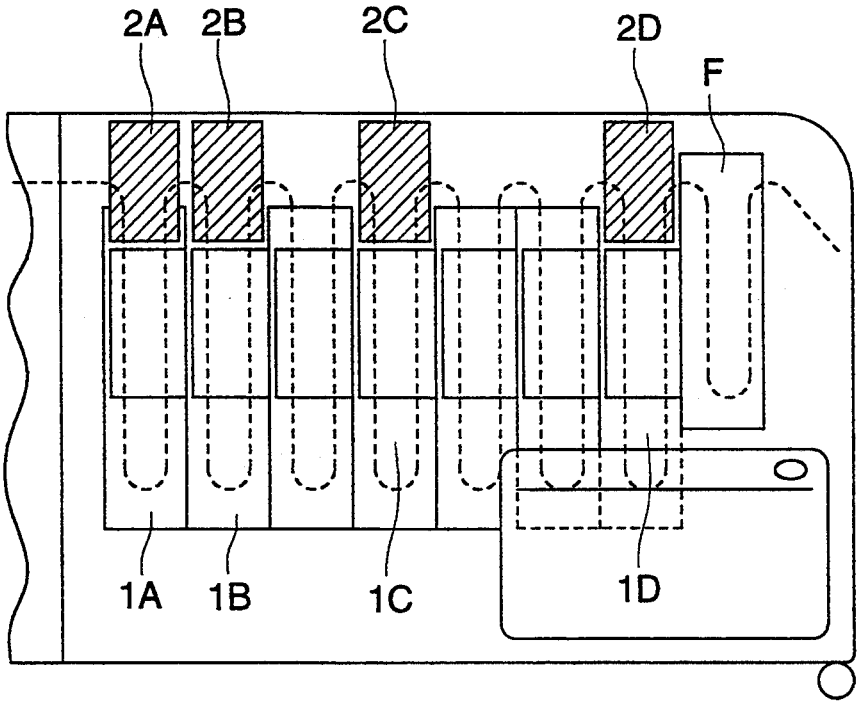
FIG. 1: A constitutional illustration showing the position of a solid processing chemical replenishing device attached to an automatic processor.

First, the compounds represented by the foregoing formula I will be detailed.

$$Rf\text{-}(X)_m\text{-}(Y)_n\text{-}A \qquad \text{Formula I}$$

wherein Rf represents an alkyl group, an alkenyl group or a alkinyl group each of which has at least one fluorine atom and, each preferably having 4 to 12 carbon atoms and more preferably having 6 to 9 carbon atoms; X represents a sulfonamido group, an

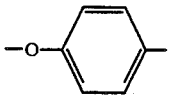

group or a $$\begin{array}{l} CH_2COOCH_2CH_2\text{—}Rf' \\ \quad | \\ \text{-}(CHCOOCH_2CH_2)\text{-} \end{array}$$

group, Y represents an alkylene oxide group or an alkylene group; Rf' represents a saturated or unsaturated hydrocarbon group containing at least one fluorine atom; A represents a hydrophilic group such as —$SO_3M$, —$OSO_3M$, —COOM, —$OPO_3$ ($M_1$) ($M_2$) and —$PO_3$ ($M_1$) ($M_2$), and preferably —$SO_3M$; in which M, $M_1$ and $M_2$ represent each H, Li, K, Na or $NH_4$, preferably K, Na or Li and most preferably Li; m is an integer of 0 or 1; and n is an integer of 0 or 1 to 10 and, preferably m is 0 and n is also 0.

Next, some typical exemplified compounds applicable to the invention will be given below.

$C_8F_{17}SO_3K$ I-1

$C_8F_{17}SO_3Li$ I-2

$C_8F_{17}COONH_4$ I-3

$C_8F_{17}COOK$ I-4

I-5

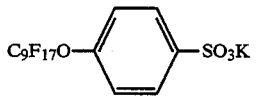

I-6

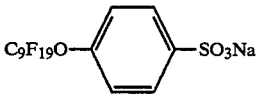

I-7

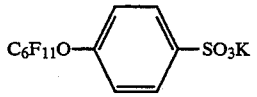

I-8

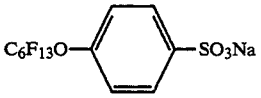

$C_7F_{15}COONH_4$ I-9

$NaO_3S-CH(CH_2COOCH_2CH_2C_8F_{17})COOCH_2CH_2C_8F_{17}$ I-10

$C_8F_{17}SO_2N(C_3H_7)CH_2COOK$ I-11

$C_8F_{17}SO_2N(C_3H_7)-CH_2CH_2OPO_3Na_2$ I-12

$C_8F_{17}SO_2N(C_{12}H_{25})(C_2H_4O)_7C_4H_8SO_3Na$ I-13

Among the compounds represented by the above-given formula [I], the particularly preferable compounds include, for example, those represented by the formulas (I-1), (I-2) and (I-4).

The amount of a compound represented by Formula I in the stabilizer composition of the invention is 0.01 g to 0.5 g, preferably 0.03 g to 0.1 g, per liter of stabilizer solution. When the composition has a solid form, the content of a compound represented by Formula I is 0.1 to 100% by weight, preferably 0.2 to 90% by weight, more preferably 1 to 30% by weight.

These compounds can be synthesized in any ordinary procedures and may also be available on the market.

Next, a solid stabilizer composition of the invention is preferable to contain a formalin-substitution compound which is a compound usable in place of formalin usually contained in an ordinary stabilizing solution for inactivating the reactive point of a magenta coupler. As the formalin-substitution-compound, a compound an aldehyde group or a methylol group, or a compound capable of releasing an aldehyde. Among them a compound having an aldehyde group is most preferable. The formalin-substitution compounds are mostly in the form of powder and they are preferable to be in the granular or tablet form. However, they have had such a disadvantage that, even if granulating or tableting them individually, the granulation can hardly be made, due to the weak bonding strength thereof and, even if tableting them, the resulting tablets are brittle. Therefore, when granulating them together with the compound formula I of the invention, granules having an even average particle size of, for example, 200 to 750 μm, can be obtained. The resulting granules has an excellent tablet-formation property and tablets with a hardness of 60 kg or more can be obtained when the glanules are tableted. Besides, there also discovered such a novel advantage that a adhesion of the granules to a tableting pastle can be prevented when tableting the granulated chemical.

The above-mentioned formaline substitution compound concretely means a compound represented by the following formula F, G, K-1, K-2 or K-3, or a hexamethylene-tetramine compound;

Formula F

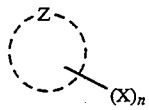

wherein Z represents a group of atoms necessary to form a saturated or unsaturated carbon ring or a saturated or unsaturated heterocyclic ring; X represents an aldehyde group,

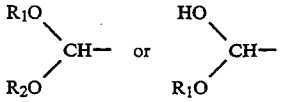

in which $R_1$ and $R_2$ represent each an alkyl group having 1 to 5 carbon atoms; and n is an integer of 1 to 4.

In formula F, Z represents a group of atoms necessary to form a substituted or unsubstituted carbon ring or a substituted or unsubstituted heterocyclic ring, provided, the carbon ring or the heterocyclic ring may be a single ring or a condensed ring and, preferably, Z is an aromatic carbon ring or heterocyclic ring each having a substituent. It is preferable that the substituent of the Z is any one of the following groups; namely, an aldehyde group, a hydroxyl group, an alkyl group such as a group of methyl, ethyl, methoxyethyl, benzyl, carboxymethyl or sulfopropyl, an aralkyl group, an alkoxy group such as a group of methoxy, ethoxy or methoxyethoxy, a halogen atom, a nitro group, a sulfo group, a carboxy group, an amino group such as a group of N,N-dimethylamino, N-ethylamino or N-phenylamino, a hydroxyalkyl group, an aryl group such as a group of phenyl or p-carboxyphenyl, an acyloxy group, an acylamino group, a sulfonamido group, a sulfamoyl group such as a group of N-ethylsulfamoyl or N,N-dimethylsulfamoyl, a carbamoyl group such as a group of carbamoyl, N-methylcarbamoyl or N,N-tetramethylenecarbamoyl or a sulfonyl group such as a group of methanesulfonyl, ethanesulfonyl, benzenesulfonyl or p-toluenesulfonyl.

The carbon rings represented by Z is, preferably, a benzene ring. The heterocyclic rings represented by Z include, preferably, a 5- or 6-membered heterocyclic ring. For example, the 5-membered ring thereof include those of thiophene, pyrrole, furan, thiazole, imidazole, pyrazole, succinimide, triazole or tetrazole; and the 6-membered rings thereof include those of pyridine, pyrimidine, triazine or thiadiazine, respectively.

The condensed rings include, for example, those of naphthalene, benzofuran, indole, thionaphthalene, benzimidazole, benzotriazole or quinoline.

Now, the exemplified compounds among the compounds represented by formula F will be given below.

F-1

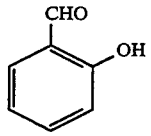

F-2

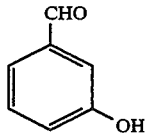

F-3

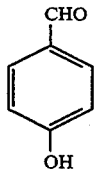

F-4

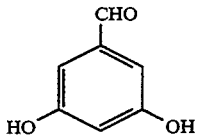

F-5

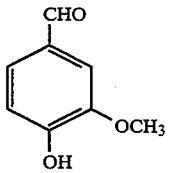

F-6

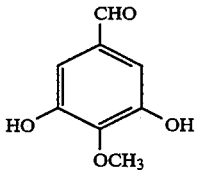

F-7

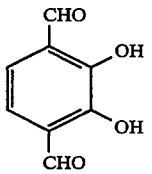

F-8

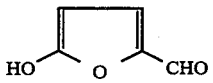

The concretely exemplified compounds thereof, besides the above, may also include the compound examples (1) through (90) given in JP O.P.I. Publication No. 4-299340/1992, pp. 9–14.

Among the concrete examples of the compounds represented by formula F, F-2 may be given as the most preferable compound thereof.

The compounds represented by formula F may readily be available as an article on the market.

A compound represented by formula F is preferably contained in a stabilizing liquid for a silver halide color photographic light-sensitive material. They may also be contained, together with a stabilizing liquid, in a processing liquid applicable to the forebath of a processing bath having a bleaching function, a processing liquid having a bleaching function, a processing liquid having a fixing function; provided that the effects of the invention shall not be spoiled.

A compound represented by formula F may be added in an amount within the range of, preferably 0.05 to 20 g per liter of a stabilizer solution used, more preferably 0.1 to 15 g and, particularly 0.5 to 10 g.

Now, the compounds represented by formula G, which are each applicable to the invention, will be detailed.

Formula G

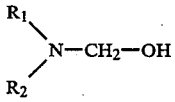

wherein $R_1$ and $R_2$ represent each a hydrogen atom, a substituent, $R_1$ and $R_2$ may be linked to form a ring containing one or two nitrogen atoms, provided, $R_1$ and $R_2$ may be the same with or the different from each other.

In the above-given formula G, the substituents represented by $R_1$ and $R_2$ shall not be specially limitative, but they may include, typically, each group of alkyl, aryl, anilino, acylamino, sulfonamido, alkylthio, arylthio, alkenyl and cycloalkyl. Besides the above, the following atom of groups may also be included therein; namely, a halogen atom, each group of cycloalkenyl, alkinyl, heterocyclic, sulfonyl, sulfinyl, phosphonyl, acyl, carbamoyl, sulfamoyl, cyano, alkoxy, aryloxy, heterocyclic-oxy, siloxy, acyloxy, carbamoyloxy, amino, alkylamino, imido, ureido, sulfamoylamino, alkoxycarbonylamino, aryloxycarbonylamino, alkoxycarbonyl, aryloxycarbonyl and heterocyclic-thio, and a spiro-compound residual group, a bridged hydrocarbon compound residual group.

The alkyl groups represented by $R_1$ and $R_2$ are preferable to have 1 to 10 carbon atoms, and they may be straight-chained or branched.

Among the aryl groups represented by $R_1$ and $R_2$, a phenyl group is preferred.

The acylamino groups represented by $R_1$ and $R_2$ include, for example, an alkylcarbonylamino group, an arylcarbonylamino group.

The sulfonamido groups represented by $R_1$ and $R_2$ include, for example, an alkylsulfonylamino group, an arylsulfonylamino group.

In an alkylthio group and an arylthio group each represented by $R_1$ and $R_2$, the alkyl moiety and the aryl moiety thereof include an alkyl group and an aryl group each represented by the above-denoted $R_1$ and $R_2$.

The alkenyl groups represented by $R_1$ and $R_2$ are preferable to have 2 to 11 carbon atoms. The cycloalkyl groups represented thereby are preferable to have 3 to 10 carbon atoms and particularly preferable to have 5 to 7 carbon atoms. The alkenyl groups may be straight-chained or branched.

The cycloalkenyl groups represented by $R_1$ and $R_2$ are preferable to have 3 to 12 carbon atoms and particularly preferable to have 5 to 7 carbon atoms.

The sulfonyl groups represented by $R_1$ and $R_2$ include, for example, an alkylsulfonyl group and an arylsulfonyl group.

The sulfinyl groups include, an alkylsulfinyl group and an arylsulfinyl group.

The phosphonyl groups include, an alkylphosphonyl group, an alkoxyphosphonyl group, an aryloxyphosphonyl group and an arylphosphonyt group.

The acyl groups include, an alkylcarbonyl group and an arylcarbonyl group.

The carbamoyl groups include, an alkylcarbamoyl group and an arylcarbamoyl group.

The sulfamoyl groups include, an alkylsulfamoyl group and an arylsulfamoyl group.

The acyloxy groups include, an alkylcarbonytoxy group and an arylcarbonyloxy group.

The carbamoyloxy groups include, an alkylcarbamoyloxy group and an arylcarbamoyloxy group.

The ureido groups include, an alkylureido group and an arylureido group.

The sulfamoylamino groups include, an alkylsulfamoylamino group and an arylsulfamoylamino group.

The heterocyclic groups are each preferable to have a 5-to 7-membered ring, and include concretely 2-furyl group, 2-thienyl group, 2-pyrimidinyl group and 2-benzothiazolyl group.

The heterocyclic-oxy groups are each preferable to have a 5- to 7-membered ring, and include, for example, 3,4,5,6-tetrahydropyranyl-2-oxy group and 1-phenyltetrazole-5-oxy group.

The heterocyclic thio groups are each preferable to have a 5- to 7-membered ring, and include, for example, 2-pyridylthio group, 2-benzothiazolylthio group and 2,4-diphenoxy-1,3,5-triazole-6-thio group.

The siloxy groups, include trimethylsiloxy group, triethylsiloxy group and dimethylbutylsiloxy group.

The imido groups, include succinimido group, 3-heptadecyl succinimido group, phthalimido group and glutarimido group.

The spiro-compound residual groups, include spiro [3.3] heptane-1-yl.

The cross-linked hydrocarbon compound residual groups, include bicyclo [2.2.1]heptane-1-yl, tricyclo [3.3.1.1]decane-1-yl and 7,7-dimethyl-bicyclo [2.2.1]heptane-1-yl.

Each of the groups represented by $R_1$ and $R_2$ include those having a substituent. The preferable substituents include a hydroxyl group, a carboxylic acid group, a sulfonic acid group, a phosphoric acid group, an amino group, an acid group and an alkoxy group.

Some exemplified compounds of the compounds represented by formula G will be given below.

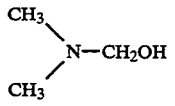

G-1

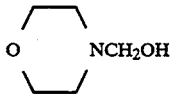

G-2

-continued

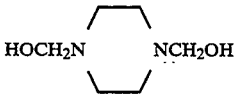

G-3

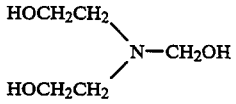

G-4

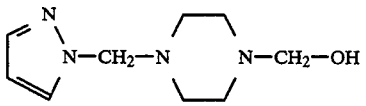

G-5

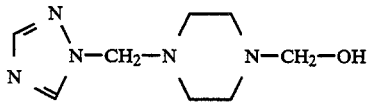

G-6

As for the exemplified compounds including the above-given compounds, the following compounds may be given; namely, the compounds (A-1) to (A-76) given in JP OPI Publication No. 4-359249/1992, pp. 10–20; compounds (X-1) to (X-76) given in JP OPI Publication No. 4-362943/1992, pp. 14–23; and the exemplified compounds (F-1) to (F-17) given in JP O.P.I. Publication No. 6-83008/1994, pp. 18–19.

Among the above-given concrete examples of the compounds represented by formula G, the most preferable compounds include compounds (G-3), (G-5) and (G-6).

The compounds represented by formula G are preferably used with a nitrogen-containing aromatic heterocyclic compound in combination. The nitrogen-containing aromatic heterocyclic compounds include, typically, 1,2,4-triazole and imidazole. They include the exemplified compounds (I-1) through (I-48) given in JP OPI Publication No. 4-359249/1991, pp. 4–7, including the above-given compounds.

A compound represented by formula G may be added in an amount within the range of, preferably 0.05 to 20 g per liter of a stabilizing liquid used, more preferably 0.1 to 15 g and, particularly 0.5 to 10 g.

Formulas K-1 to K-3 are described in the followings.

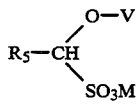

(K-1)

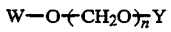

(K-2)

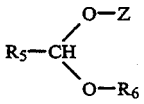

(K-3)

wherein $R_5$ is a hydrogen atom or an aliphatic hydrocarbon group; V is a group capable of releasing by hydrolysis; M is a cation; W and Y are each independently a hydrogen atom or a group capable of releasing by hydrolysis; n is an integer of 1 to 10; Z is a hydrogen atom, an aliphatic hydrocarbon group, an aryl group or a group capable of releasing by hydrolysis; and $R^6$ is an aliphatic hydrocarbon group or an aryl group; Z and $R^6$ may be linked to form a ring.

In the above Formulas K-1 to K-3, the aliphatic hydrocarbon group represented by $R_5$, $R_6$ or Z each includes an unsubstituted alkyl group such as methyl group, ethyl group or butyl group; a substituted alkyl group such as carboxymethyl group, methoxymethyl group, methoxyethyl group, hydroxyethyl group or benzyl group; an unsaturated hydrocarbon group such as aryl group or butenyl group; or a cycloalkyl group such as cyclopentyl or cyclohexyl. An aryl group represented by $R_6$ or Z may be substituted with a substituent. The substituent includes an alkyl group such as methyl group, ethyl group, methoxyethyl group, benzyl group, carboxyethyl group and sulfopropyl group; an aryl group such as phenyl group or p-methoxyphenyl group; a hydroxyl group; an alkoxyl group such as methoxy group, ethoxy group, methoxyethoxy group; an aryloxy group such as phenoxy group or p-carboxyphenoxy group; a carboxyl group; a sulfo group; an alkoxycarbonyl group such as methoxycarbonyl group or ethoxycarbonyl group; an aryloxycarbonyl group such as phenoxycarbonyl group; an amino group such as N,N-dimethylamino group, n-ethylamino group or N-phenylamino group; an acylamido group such as acetamido group or benzamido group; a carbamoyl group such as carbamoyl group, N-methylcarbamoyl group, N,N-tetramethylenecarbamoyl group; a sulfonamido group such as methanesulfonamido group or benzenesulfonamido group; a sulfamoyl group such as n-ethylsulfamoyl group or N,N-diethylsulfamoyl group; an alkylsulfonyl group such as methanesulfonyl group or ethanesulfonyl group;an arylsulfonyl group such as benzenesulfonyl group or p-toluenesulfonyl group; an acyl group such as acetyl group or benzoyl group.

The group capable of releasing by hydrolysis represented by V, W, Y or Z includes, for example, an acyl group such as acetyl group, benzoyl group, trifluoroacetyl group, or monochloroacetyl group; a trialkylsilyl group such as trimethylsilyl group.

The ring formed by linking of $R_6$ and Z is a saturated ring or condensed ring each having 5 to 8 members, which includes a ring in which a part of carbon chain of the ring is replace with a hetero atom. Examples of the ring include 1,2-dioxacyclopentane, m-dioxane, trioxane, tetraoxane and benzodioxolan.

Cations represented by M include, for example, a hydrogen atom; an alkali metal ion such as lithium ion, sodium ion or potassium ion; an alkali-earth metal ion such as magnesium ion or calcium ion; an ammonium ion; an organic ammonium ion such as triethylammonium ion, tripropylammonium ion or tetramethylammonium ion; and a prydinium ion.

In Formula K-1, an aliphatic hydrocarbon group represented by $R_5$ is preferably a lower alkyl group having 1 or 2 carbon atoms, more preferably a hydrogen atom.

Examples of compounds represented by Formula K-1, K-2 04 K-3 are given in the followings.

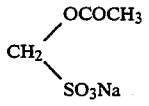
K-1-1

-continued

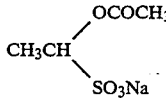
K-1-2

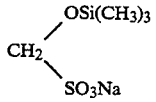
K-1-3

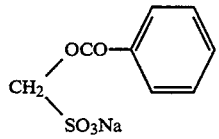
K-1-4

$CH_3COO(CH_2O)_3COCH_3$ K-2-1

$CH_3COO(CH_2O)_2COCH_3$ K-2-2

$CH_3COO(CH_2O)_4COCH_3$ K-2-3

$H(CH_2O)_{10}H$ K-2-4

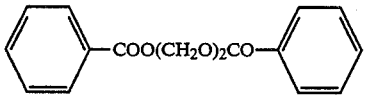
K-2-5

$(CH_3)_3SiO(CH_2O)_3Si(CH_3)$ K-2-6

$ClCH_2COO(CH_2O)_4COCH_2Cl$ K-2-7

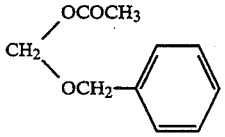
K-3-1

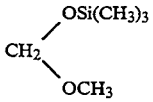
K-3-2

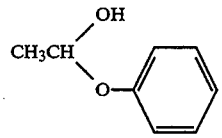
K-3-3

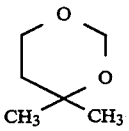
K-3-4

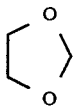
K-3-5

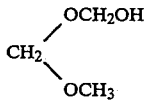
K-3-6

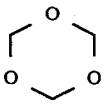
K-3-7

-continued

K-3-8

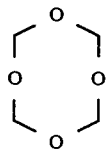

K-3-9

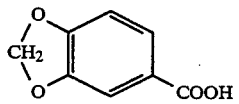

In the above compounds, K-1-1, K-1-2, K-1-3, K-2-4, K-3-4, K-3-6 and K-3-7 are preferable. The amount of the compound represented by Formula K-1, K-2 or K-3 to be added to a stabilizer solution is preferably 0.01 to 20 g/l, more preferable 0.03 to 15 g/l, particularly preferably 0.05 to 10 g/l. When the stabilizer composition is made in a solid form, the content of the compound represented by Formula K-1, K-2 or K-3 is preferably 10 to 90% by weight, more preferably 50 to 80% by weight.

A hexamethylenetetramine compound can be used other than the compound represented by Formula F, G, K-1, K-2 or K-3. Exemplified hexamethylenetetramine compounds are given below.

A-1

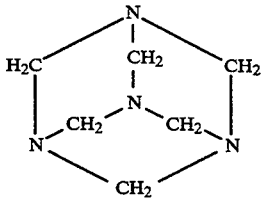

A-2

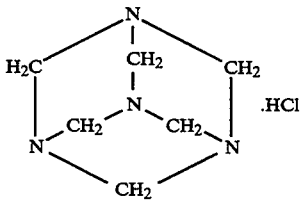

A-3

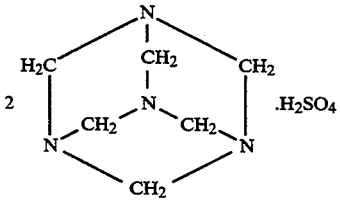

A-4

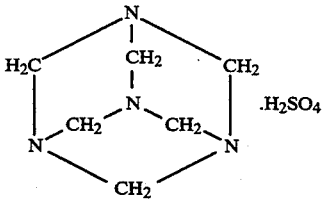

-continued

A-5

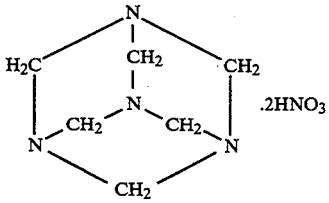

A-6

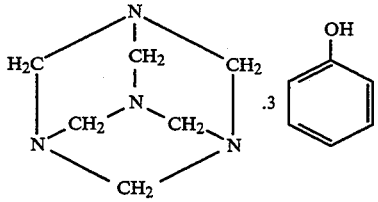

A-7

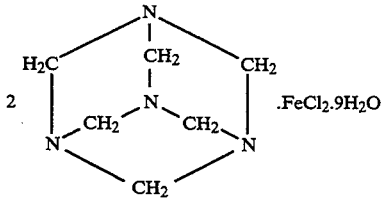

A-8

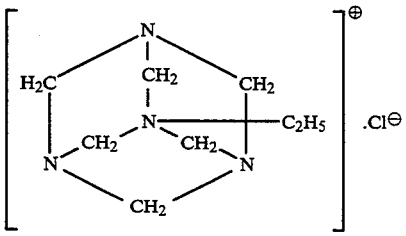

A-9

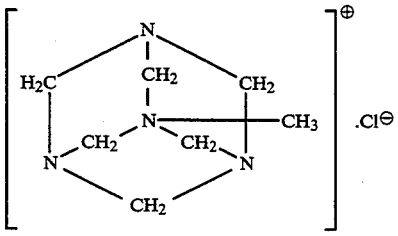

A-10

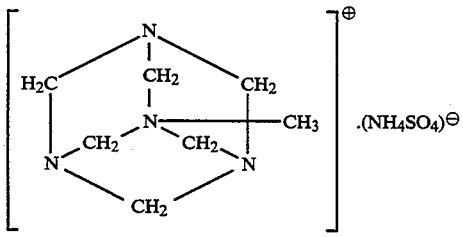

A-11

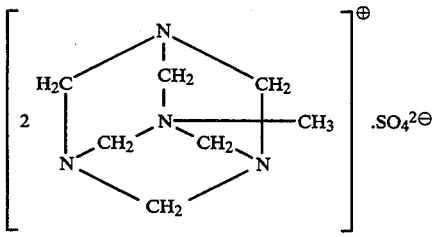

-continued
A-12
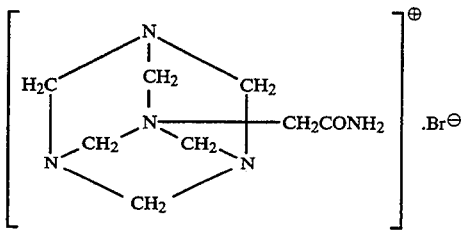
A-13
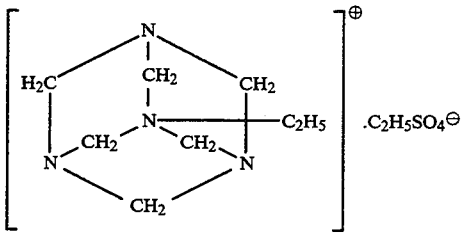
A-14
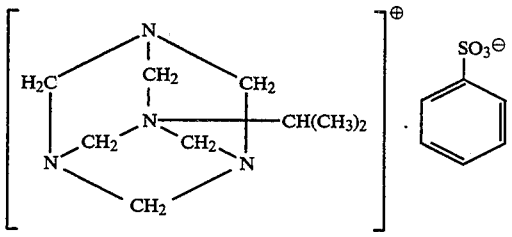
A-15
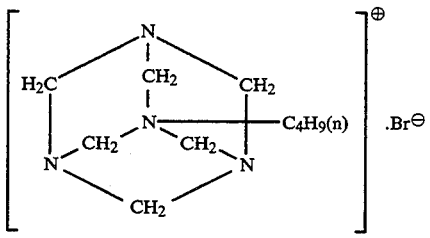
A-16
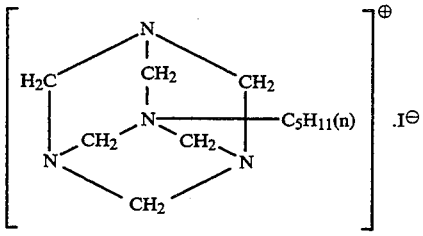
A-17
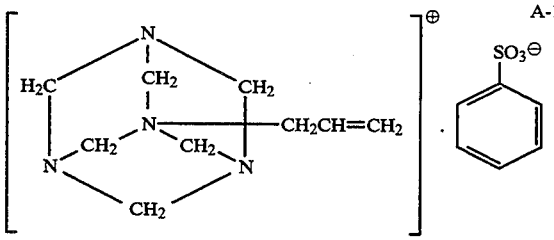
-continued
A-18
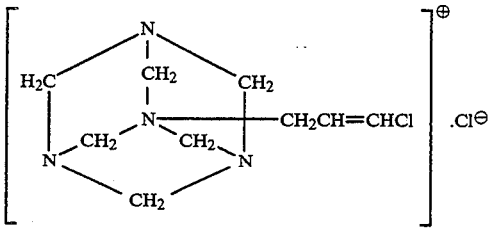
A-19
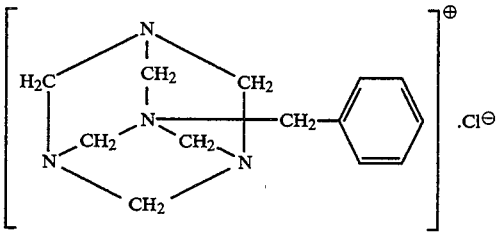
A-20
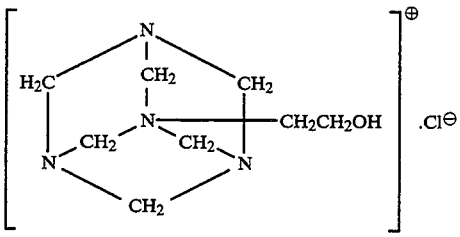
A-21
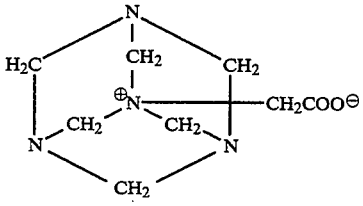
A-22
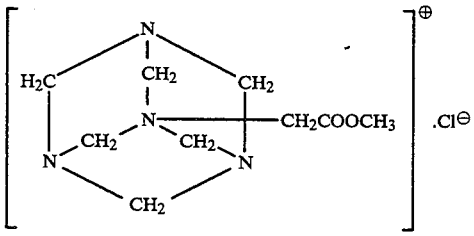
A-23
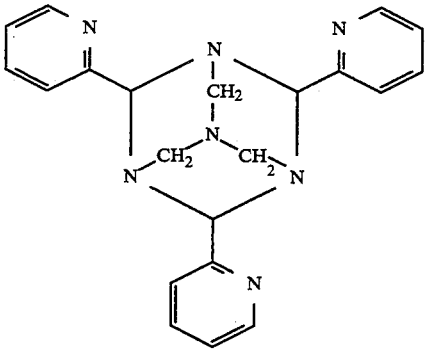

-continued

A-24

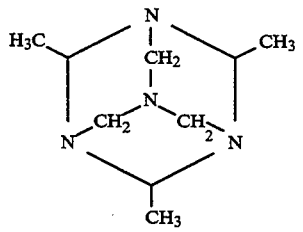

A-25

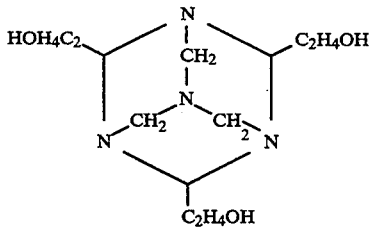

In the above compounds A-1 to A-7 are preferable and A-1 is particularly preferable. Hexamethylenetetramine compounds are available in the market, and can be prepare by well-known synthesis method.

A hexamethylenetetramine compound may be used singly or in combination with two or more kinds. The amount of the hexamethylenetetramine compound to be added to a stabilizing solution is preferably 0.01 to 20 g/l. When the stabilizer composition is made in a solid form, the content of the hexamethylenetetramine compound is preferably 10 to 90% by weight, more preferably 50 to 80% by weight.

In the invention, it is preferred that a solid stabilizer composition is to contain a chelating agent having a chelating stability constant of not lower than 8 to an iron ion. The term, a "stability constant", herein means a constant having been generally known in L. G. Sillen & A. E. Martell, "Stability Constants of Metal-ion Complexes", The Chemical Society, London, (1964); S. Chaberek & A. E. Martell, "Organic Sequestering Agents", Willey, (1959).

As for the chelating agents each having a chelating stability constant of not lower than 8 to iron ion, an organic carboxylic acid chelating agent, an organic phosphoric acid chelating agent, an inorganic phosphoric acid chelating agent and a polyhydroxy compound may be included. The above-mentioned iron ion means a ferric ion or $Fe^{3+}$.

As for the concrete examples of the compounds for a chelating agent having a chelating stability constant of not lower than 8 to ferric ion, the following compounds may be included therein, however, there is no limitation thereto. Namely, ethylenediaminediorthohydroxyphenylacetic acid, diaminopropanetetraacetic acid, nitrilotriacetic acid, hydroxyethylenediaminetriacetic acid, dihydroxyethyl glycine, ethylenediaminediacetic acid, ethylenediaminedipropionic acid, iminodiacetic acid, diethylenetriaminepentaacetic acid, hydroxyethyliminodiacetic acid, diaminopropanoltetraacetic acid, transcyclohexanediaminetetraacetic acid, glycoletherdiaminetetraacetic acid, ethylenediaminetetrakismethylenephosphonic acid, nitrilotrimethylenephosphonic acid, 1-hydroxyethylidene-1,1-diphosphonic acid, 1,1-diphosphonoethane-2-carboxylic acid, 2-phosphonobutane-1,2,4-tricarboxylic acid, 1-hydroxy-1-phosphonopropane-1,2,3-tricarboxylic acid, catechol-3,5-diphosphonic acid, sodium pyrophosphate, sodium tetrapolyphosphate and sodium hexametaphosphate. Among them, the particularly preferable compounds include, for example, diethylene triamine pentaacetic acid, nitrilotriacetic acid, nitrilotrimethylene phosphonic acid and 1-hydroxyethylidene-1,1-diphosphonic acid and, most preferably applicable compounds include, for example, 1-hydroxyethylidene-1,1-diphosphonic acid.

The above-mentioned chelating agents may be used in an amount within the range of, preferably 0.01 to 50 g per liter of a stabilizer solution used and, more preferably 0.05 to 20 g, so that an excellent result can be obtained.

The compounds preferably added to a solid stabilizer composition include, for example, an ammonium compound. The ammonium compounds may be supplied from an ammonium salt of various kinds of inorganic compounds. The ammonium salts thereof include, typically, ammonium bromide, ammonium carbonate, ammonium chloride and ammonium phosphate. They may be used independently or in combination. Such an ammonium compound as mentioned above may be added in an amount within the range of, preferably 0.001 to 1.0 mol per liter of a stabilizer solution used therein and, more preferably 0.002 to 2.0 mols.

Further, a solid stabilizer composition is preferable to contain a sulfite. The sulfites may be any one regardless of an organic or inorganic matter, provided that the sulfites are capable of releasing a sulfite ion. However, an inorganic salts thereof is preferred. The preferable compounds thereof include, typically, sodium sulfite, potassium sulfite, ammonium sulfite, ammonium bisulfite, potassium bisulfite, sodium bisulfite, sodium metabisulfite, potassium metabisulfite, ammonium metabisulfite and hydrosulfite.

The above-mentioned sulfites may be added to a solid stabilizer composition, preferably in such an amount as to be at least $1\times10^{-3}$ mols per liter and, more preferably in such an amount as to be within the range of $5\times10^{-3}$ to $10^{-1}$ mols per liter of a stabilizer solution prepared from the composition. If this is the case, it is effective to prevent a stain production.

A solid stabilizer composition is preferable to contain a metal salt together with the above-mentioned chelating agent in combination. The metal salts include, for example, those of Ba, Ca, Ce, Co, In, La, Mn, Ni, Bi, Pb, Sn, Zn, Ti, Zr, Mg, Al or Sr. They may be supplied as an inorganic salt such as a halide, hydroxide, sulfate, carbonate, phosphate and acetate, or as a water-soluble chelating agent. An amount thereof to be used is within the range of, preferably $\mathbf{1\times10^{-4}}$ to $1\times10^{-1}$ mols per liter of a stabilizer solution used therein and, more preferably $4\times10^{-4}$ to $2\times10^{-2}$ mols.

A solid stabilizer composition may contain an organic acid salt such as a citrate, an acetate, a succinate, an oxalate and benzoate; and a pH controller such as a phosphate, borate, hydrochloric acid, sulfate. Each of the above-mentioned compounds may be added in any amount in combination without any problem, provided that the amount thereof is good enough to keep the pH of a stabilizer solution, and that a storage stability of a color photographic image stability in storage, and a precipitation preventability, of the solution may not be affected.

In the invention, it is preferable to make combination use of any well-known antimold such as 5-chloro-2-methylisothiazoline-3-one and benzisothiazoline with a solid stabilizer composition of the invention, provided that the effects of the invention shall not be spoiled.

In a processing method applied with a solid stabilizing chemical of the invention, the preferable processing steps may be given for example as follows.

(1) Color developing→Bleach-fixing→Stabilizing;
(2) Color developing→Bleaching→fixing→Stabilizing;
(3) Color developing→Bleaching→Bleach-fixing→Stabilizing;
(4) Color developing→Bleach-fixing→fixing→Stabilizing;
(5) Color developing→Bleach-fixing→Bleach-fixing→Stabilizing; and
(6) Color developing→Bleaching→Bleach-fixing→Fixing→Stabilizing;

Processing steps (1), (2) and (3) are preferable and processing step (2) is particularly preferable. In the meantime, when expressing a processing solution having a fixing function in the invention, there are various processing solutions or the combination thereof, such as a bleach-fixer, a combination of a bleacher and a fixer, a combination of a bleacher and a bleach-fixer, a combination of a bleach-fixer and a fixer, and a combination of a bleach-fixer and another bleach-fixer, according to the processing steps such as mentioned above. In the invention, the preferable processing liquid having a fixing function is a fixer.

A stabilizer composition may be solidified in any desired means in which, for example, a condensed, finely powdered or granulated stabilizer composition is kneaded with a water-soluble binder so as to mold it into the solid thereof, or a water-soluble binder is sprayed or like-treated over the false-molded surface of a stabilizer composition, so that a coated layer is formed thereon. (See JP O.P.I. Publication Nos. 4-29136/1992, 4-85535/1992, 4-85536/1992, 4-85533/1992, 4-85534/1992 and 4-172341/1992.)

Although, the solid stabilizer composition of the invention includes ones in forms of powder, granule, pill and tablet, granule and tablet are preferable forms.

The preferable tablet preparation methods include, for example, a method in which a powdered stabilizer composition is granulated and is then subject to a tableting step so that the tablets thereof can be prepared. This method can be advantageous to improve a solubility and preservability of the resulting tablets and can also be stable in photographic characteristics as the results, as compared to any solid stabilizing composition formed simply by mixing the solid chemical components and then by forming the tablets thereof in a tableting step.

Granulation methods applicable to form tableted stabilizing composition include, for example, a rolling granulation method, an extrusion granulation method, compression granulation method, a cracking granulation method, a stirring granulation method, a fluid-bed granulation method and a spray-drying granulation method.

An average grain size of the resulting granules is within the range of, preferably 100 to 800 μm and, more preferably 200 to 750 μm. When the average grain size thereof is smaller than 100 μm or is larger than 800 μm, it is not preferable, because the components of the granules may not become uniformed so that the so-called segregation may be produced, when the granules are mixed up and are then compressed.

A grain-size distribution is preferable when not less than 60% of the grains of the resulting granules are within the deviation range of ±100 to 150 μm.

When compressing the resulting granules, any well-known compressors such as an oil-hydraulic press, a single-shot type tableting machine, a rotary type tableting machine and a briquetting machine may be used.

It is allowed that the content of moisture of the solid stabilizing composition for a silver halide photographic light-sensitive material of the present invention is in the range of 0.1 to 15 weight %. However, considering the effects of the present invention, the moisture content is preferably in the range of 0.3 to 10 weight %.

The moisture content defined in the present invention is a moisture content ratio wherein a stabilizing composition is heated up to 105° C. until the stabilizing composition comes to have a fixed weight, the weight reduced is calculated and this reduced weight is calculated as an amount of moisture contained.

Bulk-density is defined as follows. In the case of granule stabilizing composition, 10 g of a sample is poured calmly to a commercially-available glass graduate for 25 milliliter. Its volume is measured. The specific volume is defined to be (bulk density) = (weight)/(volume). In the case of a tablet type stabilizing composition, the specific volume is defined to be (bulk density) = (weight)/(volume).

When making a granulation, the above-mentioned effects can more preferably be displayed by separately granulating each of the components such as an alkalizer, a reducer, a bleacher and a preserver.

When the above-mentioned solid processing chemical is of the tablet type, the bulk-density thereof is preferably within the range of 1.0 g/cm$^3$ to 2.5 g/cm$^3$, more preferably 1.5 g/cm$^3$ to 2.0 g/cm$^3$, from the viewpoints of the solubility thereof and the effects of the invention. It is preferable, from the viewpoint of the strength of the resulting solid, when the bulk density thereof is higher than 1.0 g/cm$^3$, and it is also preferable, from the viewpoint of the solubility of the resulting solid, when the bulk density is lower than 2.5 g/cm$^3$. When a solid processing chemical is of the granular shape, the bulk-density thereof is preferably within the range of 0.4 to 1.7 g/cm$^3$, more preferably 0.7 to 1.25 g/cm$^3$.

In a tablet type solid stabilizer composition of the invention, the physical strength Z thereof is to be within the range of not less than 0.8 to not more than 4 and, preferably, not less than 1.5 to not more than 3.5. A physical strength Z herein used will be defined by the following formula.

Z = Press-cracking strength in kg of a subject tablet / Longitudinal length of a subject tablet (in mm)

A press-cracking strength of a tablet means a cracking strength when a pressure is applied to the longitudinal direction of a subject tablet, and it may be measured by making use of any instruments available on the market such as a Monsanto type hardness tester, a Stork type hardness tester and a Speed-Checker (manufactured by Okada Seiko Co.).

A tablet of the invention may take any forms, however, a disk-shaped tablet is preferred from the viewpoints of productivity and handling convenience. When a tablet is disk-shaped, the longitudinal length of the tablet means the diameter of the tablet. The diameter thereof at that time may be freely selected so as to meet the application purpose of the tablet. From the viewpoint of the productivity, the diameter of a tablet or a tablet size is to be within the range of, preferably, 5 to 50 mm and, more preferably 7 to 30 mm. On the other hand, a ratio of a longitudinal length x of a tablet to a thickness h of the tablet, x / h, is to be within the range of 1.0 to 6.0 and, more preferably 2.5 to 5.0.

In the application modes of a tablet type solid stabilizer composition of the invention, any desired methods can be taken so as to meet the purposes. However, from the viewpoints of the miniaturization of an automatic processor and the reduction of a waste processing solution, it is preferable to put the tablet as a replenisher directly into a processing tank of an automatic processor.

From the viewpoint of the productivity, a tablet of the invention is preferable to be within the range of 0.1 to 30 g in weight per piece.

In the invention, a solid stabilizer composition may be supplied to an automatic processor in the following manner, for example. The area of a processed light-sensitive material is integrated through a detection device attached to a light-sensitive material insertion inlet of the automatic processor. Every time when reaching a certain unit, a processing chemical for replenishment is supplied in a specific amount directly to the processing tank section of the automatic processor or, in the case that the processing chemical for replenishment is solidified, every one or several pieces of the tablets are supplied directly to the above-mentioned processing tank section of the automatic processor.

The above-mentioned subject light-sensitive material area detection device may be any types thereof, such as those of the micro-switch system, infra-red system and supersonic system, provided that a light-sensitive material subject to a processing can be detected without fail.

In a method of supplying a solid stabilizer composition, the composition is directly supplied to a processing tank of an automatic processor, such as a processing solution tank and a processing solution circulation system, or a thermostat tank and a processing solution filtration section.

When making use of a solid stabilizer composition, the sizes and shapes of the solid composition may freely be varied so as to meet a unit for supplying the stabilizer composition. It is preferable that a solid stabilizer composition is supplied from the upper part of the above-mentioned processing liquid tank, processing liquid circulation system, thermostat tank and processing liquid filtration section, through a supplying mechanism, upon receipt of a signal sent from a light-sensitive material area detection device, every time when reaching a unit.

It is also preferable that the solid stabilizer composition supplying section is so devised as not to bring a solid stabilizer composition into contact, before a supply of the composition, with any processing liquid sent flying about from a processing tank section of an automatic processor, a temperature of the air and/or a light-sensitive material being processed.

Figure 4:
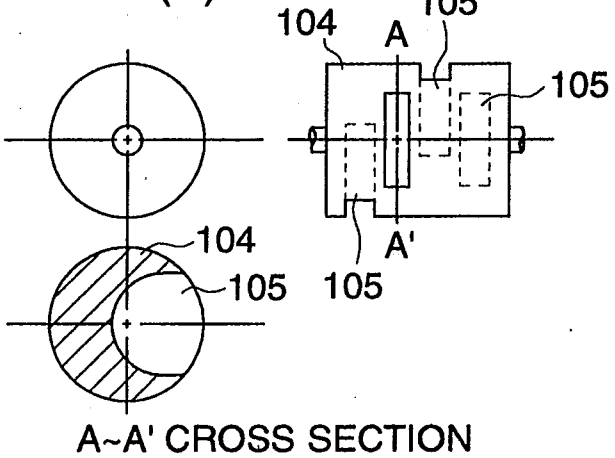
FIG. 4(A), (B) & (C): A constitutional illustration showing an example of solid processing chemical supply devices, an illustration showing a rotary cylinder, and a perspective view of a sliding type cap and cartridge (i.e., an ejection section)
Figure 4:
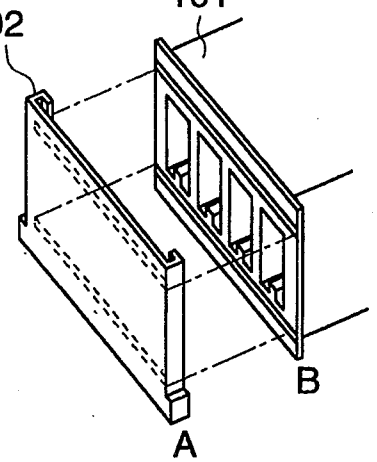
Figure 4:
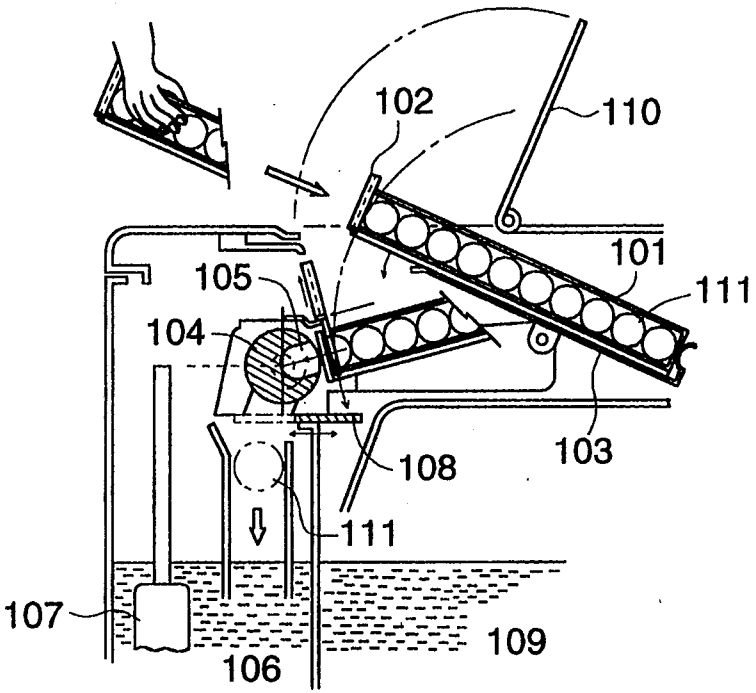

FIG. 4 illustrate an example of the solid processing composition supplying apparatus when the tablets are stored by getting them fallen in, as a solid processing composition kit.

A solid processing composition 16 is housed in housing cylinder 23-1, 23-2 and 23-3 for the solid processing composition in a prescribed amount, and loaded on housing unit 13. Depending upon the processing amount of the light-sensitive material, rotating plate 21 which is connected to motor 14 is rotated. One of the solid processing composition housed in cylinder 23-1 for a solid processing composition is housed in a conveyance pocket for the solid processing composition. The solid processing composition is conveyed to dropping port 22. The processing composition is supplied to a filter tank (or a dissolution tank) provided in a processing tank in an automatic processing machine one tablet by one.

Wherein a solid processing composition, hereinafter referred to as a tablet or tableted chemical 111 is stored in container or cartridge 101 partitioned into several chambers, and is sealed tightly by sliding type cap 102. When setting the cartridge on cartridge support table 103 of a solid processing chemical automatic supply device equipped to the upper part of a processing tank of an automatic processor, cap 102 is opened so that a tablet may tumbled down from the cartridge fixed obliquely to notched inlet 105 of rotary cylinder 104. Each of the notched inlet 105 of the rotary cylinder 104 is notched alternately so that several tablets stored in separate chambers inside a cartridge may not be tumbled down at the same time.

Rotary cylinder 104 is so rotated as to meet an amount of light-sensitive materials processed and, at the same time, shutter 108 is so opened as to put one each of tablets into a filtration tank or a dissolving tank 106 with a filter 107 provided with a processing tank 109 in combination. 111 is a top cover of the apparatus.

Figure 5:
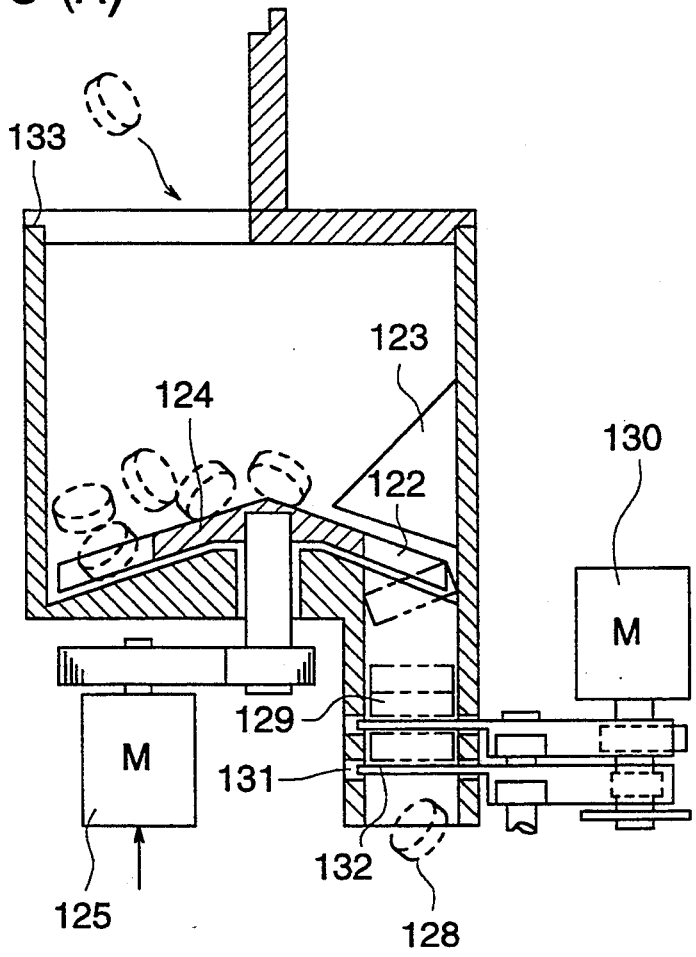
FIG. 5: A cross-sectional view of an example of part-feeder type supply devices, and a perspective view of a solid processing chemical package.
Figure 5:
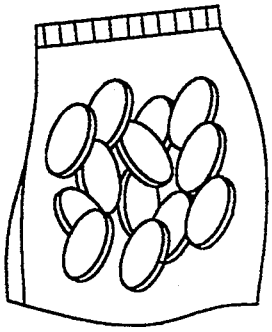

FIG. 5 illustrates an example of a part feeder system tablet supply device for a collectively packaged tablets relating to the invention, as well as a solid composition package.

A packaging material of collectively packaged tableted chemicals is unsealed and is then put into hopper 133. Movable member 124 is rotated to meet an amount of light-sensitive materials processed, and the tablets of composition 128 are then fallen in a tablet alignment section 129. When a certain tablets are aligned in, movable member 124 is stopped in action. At this moment, sweeper 123 is remarkably effective to insert a series of tablets into pocket 122 of removable member 124 so as to align in tablet alignment section 129.

Shutter No.1, 131, is rotated to meet the amount of light-sensitive materials processed and tableted chemical is then fallen down. Next, shutter No.1, 131, is rotated reversely so as to sandwich one tablet between shutters 131 and 132. When shutter 132 is rotated, tableted chemical is passed through an ejection section and is then supplied to a liquid preparation section. After that, shutter 132 is reversely rotated and shutter 131 is closed. The apparatus are drived by mortors 125 and 130.

EXAMPLES

Example 1

According to the following procedures, there prepared a solid stabilizer composition for color negative use, of the invention, in an equivalent amount to 100 liters of a replenishing solution.

Procedure (1)

In an air-jet fine pulverizer, 200 g of m-hydroxybenzaldehyde, hereinafter sometimes abbreviated to as mHBA, and 21 g of lithium hydroxide monohydrate were each pulverized up to have an average particle size of 10 μm.

In a room rehumidified to be 25° C. and not higher than 40%RH, the resulting pulverized matters were uniformly mixed together by making use of a mixer for 10 minutes, so that a pulverized mixture A-1 was obtained.

Procedure (2)

In a fluidizing-bed spray-granulator available on the market, the resulting pulverized mixture A was granulated by spraying 3.0 ml of water for about 7 minutes at room temperature, and the resulting granules were dried at 45° C. for 8 hours. Then, the granules were dried up in a vacuum at 40° C. for 2 hours so that the moisture content of the granules became within the range of 0.1 to 0.3 weight %. Then granules A-2 was obtained. The size and the bulk-density of the granules A-2 were 300 to 600 μm and 0.8 g/cm$^3$, respectively.

Procedure (3)

The granules A-2 were further compression-tableted by making use of a modified model of Touch-Pressed Collect 1527HU tableting machine manufactured by Kikusui Mfg. Works so as to have a filling amount of 9.0 g per tablet. Thereby, 24 pieces of stabilizer-replenishment tablets A-3 for color negative use having a tablet size of 30 mm was prepared. The bulk-density of the tablet was 1.7 g/cm$^3$.

Procedure (4)

Emulgen 985, polyoxyethylene nonylphenyl ether, was added to 200 g of m-hydroxybenzaldehyde and 21 g of lithium hydroxide monohydrate, and a pulverization, granulation and tableting operations were carried out in the same manner as in procedures (1) through (3), so that pulverized mixtures B-1, granules B-2 and tablets B-3 were obtained.

Procedure (5)

Next, a series of pulverization, granulation and tableting operation were carried out in the same manner as in procedures (1) through (3), except that Emulgen 985 was replaced by tetramethyl ammonium chloride, so that pulverized mixture C-1, granules C-2 and Tablets C-3 were obtained.

Procedure (6)

Further, pulverized mixtures D-1 through J-1, granules D-2 through J-2 and tablets D-3 through J-3 each could be obtained, respectively, by making use of a compound represented by formula I in place of tetramethyl ammonium chloride.

Samples A-1 through J-3 prepared in the above-mentioned procedures were tightly sealed in a polyethylene-made envelopes, respectively, and liquid Z was remained as it was. They were each subjected to preservation tests under the following conditions; at −1° C. for one week; successively at 50° C. and 60%RH for another week, and at −1° C. for further one month. The preservability of the samples were evaluated by the following procedures.

(Evaluation method)

(A) Reduction rate of m-HBA

The sample, after being stored, was unsealed. In the case of granule, 45 g was picked up, and in the case of tablet composition, 5 tablets were picked up. They were dissolved in 1 l of water completely, and their light-absorption degrees at 254 nm were measured by means of a spectrophotometer (UV-160A produced by Shimadzu Seisakusho). Succeedingly, by the comparison with samples before being stored, the reduction rate after being stored was calculated.

(B) Conditions after being stored

The samples after being stored were unsealed and observed visually.

Conditions after being stored:

A: There appeared no change between before and after storage.

B: Though there appeared to be slight dot, little change was observed.

C: The surface was colored to black.

D: The form was changed and the surface was also colored to black.

(C) Swelling rate of diameter

The tablet samples after being stored were unsealed. From them, 10 tablets were picked up, and their diameters were measured with vernier calipers. The average value was compared the diameter size before being stored. Thus, the swelling rate was calculated.

(D) Blocking (block of granule)

Crushed mixtures and granule samples after being stored were unsealed. After picking up 40 g, they were filtered by a screen with a mesh of about 2 mm. The remaining granule was checked visually for the evaluation on blocking.

Whether or not there are blocking:

A: All of crushed mixtures and granules passed the screen.

B: Though about 1 to 2% of the whole remained. However, when they were crushed with a finger, all of them passed the screen.

C: More than 10% of the whole remained. Even when the remaining was crushed with a finger, 1 to 2% could not be crushed.

D: More than 20% could not be crushed with a finger.

TABLE 1

| Exp. No.1 | Sample | Surfactant | m-HBA reduction ratio (%) | State after preserved | Swelling ratio of diameter (%) | Blocking | Remarks |
|---|---|---|---|---|---|---|---|
| 1-1 | A-1 | Not added | 21 | C | — | D | Comp. |
| 1-2 | A-2 | Not added | 17 | C | — | C | Comp. |
| 1-3 | A-3 | Not added | 15 | B | 5.2 | — | Comp. |
| 1-4 | B-1 | Emulgen 985 | 25 | D | — | D | Comp. |
| 1-5 | B-2 | Emulgen 985 | 28 | D | — | D | Comp. |
| 1-6 | B-3 | Emulgen 985 | 30 | D | 7.8 | — | Comp. |
| 1-7 | C-1 | Tetramethyl ammonium chloride | 18 | C | — | D | Comp. |
| 1-8 | C-2 | Tetramethyl ammonium chloride | 12 | B | — | C | Comp. |
| 1-9 | C-3 | Tetramethyl ammonium chloride | 10 | B | 6.3 | — | Comp. |
| 1-10 | D-1 | I-1 | 0 | B | — | B | Inv. |
| 1-11 | D-2 | I-1 | 0 | A | — | A | Inv. |
| 1-12 | D-3 | I-1 | 0 | A | 0.1 | — | Inv. |
| 1-13 | E-1 | I-2 | 0 | A | — | A | Inv. |
| 1-14 | E-2 | I-2 | 0 | A | — | A | Inv. |

TABLE 1-continued

| Exp. No.1 | Sample | Surfactant | m-HBA reduction ratio (%) | State after preserved | Swelling ratio of diameter (%) | Blocking | Remarks |
|---|---|---|---|---|---|---|---|
| 1-15 | E-3 | I-2 | 0 | A | 0.0 | — | Inv. |
| 1-16 | F-1 | I-4 | 0 | B | — | B | Inv. |
| 1-17 | F-2 | I-4 | 0 | A | — | A | Inv. |
| 1-18 | F-3 | I-4 | 0 | A | 0.1 | — | Inv. |
| 1-19 | G-1 | I-5 | 1 | B | — | B | Inv. |
| 1-20 | G-2 | I-5 | 0 | B | — | A | Inv. |
| 1-21 | G-3 | I-5 | 0 | A | 0.1 | — | Inv. |
| 1-22 | H-1 | I-10 | 1 | B | — | B | Inv. |
| 1-23 | H-2 | I-10 | 1 | B | — | A | Inv. |
| 1-24 | H-3 | I-10 | 0 | A | 0.1 | — | Inv. |
| 1-25 | J-1 | I-12 | 1 | B | — | B | Inv. |
| 1-26 | J-2 | I-12 | 0 | B | — | A | Inv. |
| 1-27 | J-3 | I-12 | 1 | A | 0.1 | — | Inv. |

m-HBA: m-hydroxybenzaldehyde

From the results shown in the above-given Table 1, it was proved that the solid stabilizer composition of the invention were each remarkably excellent in preservation stability, because the after-preservation states and the m-hydroxybenzaldehyde reduction ratios were each satisfactory.

Example 2

Next, the same tableted compositions as in Example 1 were made for evaluation except that mHBA (exemplified compound (F-2)) in Experiment 1–15 were replaced with compounds shown in Table 2. Table 2 shows the results thereof.

TABLE 2

| Exp. No. | Exemplified compound | Reductin ratio of compound | State after pre-served | Swelling ratio of diameter (%) | Remarks |
|---|---|---|---|---|---|
| | None | — | B | 0.8 | Invention |
| 2-1 | F-1 | 0 | A | 0.0 | Invention |
| 2-2 | F-2 | 0.1 | A | 0.1 | Invention |
| 2-3 | F-3 | 0.1 | A | 0.2 | Invention |
| 2-4 | G-3 | 0.1 | B | 0.3 | Invention |
| 2-5 | G-5 | 0.1 | B | 0.1 | Invention |
| 2-6 | G-6 | 0 | A | 0.4 | Invention |
| 2-7 | K-1-1 | 0.2 | A | 0.3 | Invention |
| 2-8 | K-1-2 | 0.1 | A | 0.5 | Invention |
| 2-9 | K-1-3 | 0.1 | B | 0.3 | Invention |
| 2-10 | K-2-4 | 0.2 | B | 0.3 | Invention |
| 2-11 | K-3-4 | 0.1 | B | 0.5 | Invention |
| 2-12 | K-3-6 | 0.1 | B | 0.5 | Invention |
| 2-13 | K-3-7 | 0.2 | B | 0.1 | Invention |
| 2-14 | A-1 | 0.1 | A | 0.4 | Invention |
| 2-15 | A-2 | 0.2 | A | 0.3 | Invention |
| 2-16 | A-3 | 0.2 | B | 0.4 | Invention |
| 2-17 | A-5 | 0.2 | B | 0.5 | Invention |
| 2-18 | A-7 | 0.2 | B | 0.5 | Invention |

From the above-mentioned results, it can be understood that, when a formaldehyde substitute is used in combination, the effects of the present invention can be provided more noticeably.

Example 3

Granules with high bulk density as described in Table 3 were prepared in the same manner as in Example 1 wherein time for kneading in granulating and the amount of water added were changed. In addition, by adjusting tableting pressure in compression, tablet compositions with bulk densities shown in Table 3 were prepared. Samples prepared in the above-mentioned manner were enveloped in a polyethylene sack hermetically, and stored at −1° C. for 2 weeks. Consecutively, they were stored for 1 week at 60° C. and 80%RH, and additionally, for 1 month at −1° C. They were subjected to the same evaluation as in Example No. 1. Table 3 shows the results thereof.

TABLE 3

| Exp. No. | Form of composition | Bulk-density (g/cm$^3$) | m-HBA reduction ratio (%) | State after preserved | Swelling ratio of diameter (%) | Blocking | Remarks |
|---|---|---|---|---|---|---|---|
| 3-1 | Granule | 0.2 | 0.4 | B | — | B | Invention |
| 3-2 | Granule | 0.4 | 0.1 | B | — | B | Invention |
| 3-3 | Granule | 0.7 | 0.0 | A | — | A | Invention |
| 3-4 | Granule | 1.25 | 0.0 | A | — | A | Invention |
| 3-5 | Granule | 1.7 | 0.1 | B | — | B | Invention |
| 3-6 | Granule | 2.0 | 0.4 | B | — | B | Invention |
| 3-7 | Tablet | 0.8 | 0.3 | B | 0.8 | — | Invention |
| 3-8 | Tablet | 1.0 | 0.1 | B | 0.3 | — | Invention |
| 3-9 | Tablet | 1.5 | 0.0 | A | 0.1 | — | Invention |
| 3-10 | Tablet | 2.0 | 0.0 | A | 0.1 | — | Invention |
| 3-11 | Tablet | 2.5 | 0.1 | B | 0.1 | — | Invention |
| 3-12 | Tablet | 2.8 | 0.3 | B | 0.1 | — | Invention |

From Table 3, it can be understood that the solid processing compositions of the present invention shows excellent preservability and that, in the case of granule, the bulk density of 0.4 to 1.7 g/cm$^3$ provides excellent effects and that of 0.7 to 1.25 g/cm$^3$ provides more excellent effects. In addition, in the case of tablet composition, the bulk density of 1.0 to 2.5 provides excellent effects and that of 1.5 to 2.0 g/cm$^3$ provides more excellent effects.

Example 4

Samples having moisture content as shown in Table 4 were prepared in the same manner as in Experiment Nos. 1 through 15 of Example 1 wherein drying time was adjusted. Samples prepared in the above-mentioned manner were enveloped in a polyethylene sack tightly, and stored for 2 weeks at −1° C. Consecutively, they were stored for 1 week at 60° C. and 80%RH, and additionally, for 1 month at −1° C. They were subjected to the same evaluation as in Example No. 1. Table 4 shows the results thereof.

TABLE 4

| Exp. No. | Form of composition | Bulk-density (g/cm³) | m-HBA reduction ratio (%) | State after preserved | Swelling ratio of diameter (%) | Remarks |
|---|---|---|---|---|---|---|
| 4-1 | | 0.05 | 0.0 | B | 0.3 | Invention |
| 4-2 | Tablet | 0.1 | 0.0 | B | 0.0 | Invention |
| 4-3 | Tablet | 0.3 | 0.0 | A | 0.0 | Invention |
| 4-4 | Tablet | 5.0 | 0.0 | A | 0.0 | Invention |
| 4-5 | Tablet | 10.0 | 0.0 | A | 0.0 | Invention |
| 4-6 | Tablet | 15.0 | 0.1 | B | 0.3 | Invention |
| 4-7 | Tablet | 18.0 | 0.5 | B | 0.6 | Invention |

From Table 4, it can be understood that the solid processing composition of the present invention shows excellent preservability. When the moisture content is 0.1 to 15 weight %, it provides more excellent effects, and when the moisture content is 0.3 to 10 weight %, it provides especially more excellent effects.

Example 5

The replenishment section of a color negative film processor CL-KP-50QA was modified as shown in FIG. 1 and a Konica Color Super DD100 film was exposed imagewise to light. Then, a vertical column-shaped vessel containing tablets was set on a tablet putting-in section, and 15 rolls of the exposed films were processed a day. As the tablet replenishing apparatus, one illustrated in FIG. 3 was used.

FIG. 1 illustrates a position where each of solid processing composition replenishment devices 2A, 2B, 2C and 2D is attached to a KP-50QA (automatic processor A); wherein solid processing chemical replenishment devices 2A, 2B, 2C and 2D are attached to the positions indicated by oblique lines above color developing tank 1A, bleaching tank 1B, fixing tank 1C and stabilizing tank 1D, respectively. F is a drying section.

Figure 2:
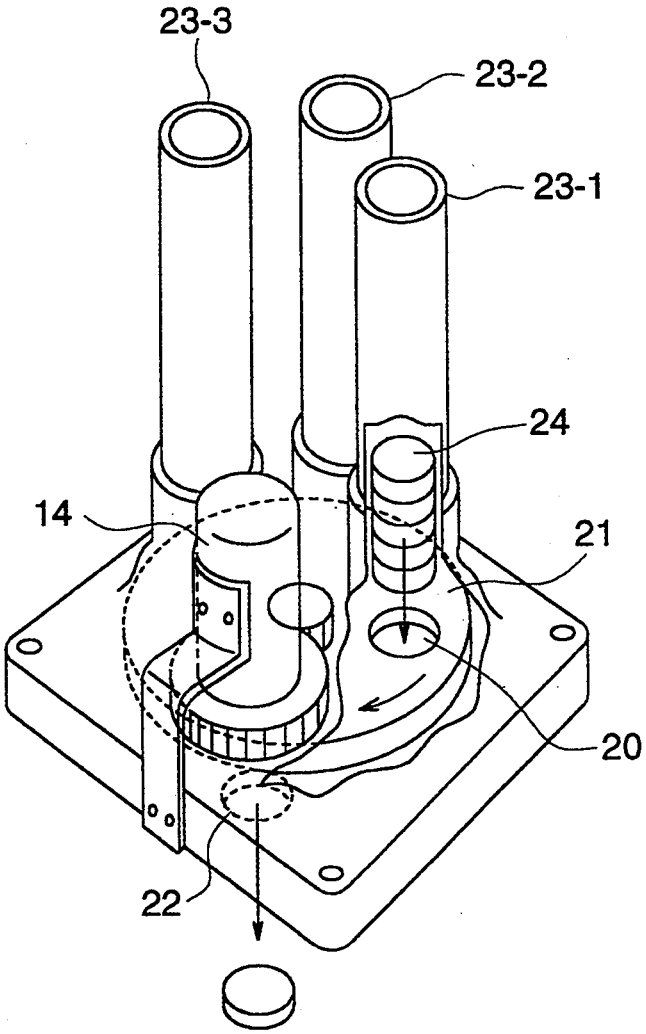
FIG. 2: A constitutional illustration showing a solid processing chemical putting-in device attached to a developing tank.
Figure 3:
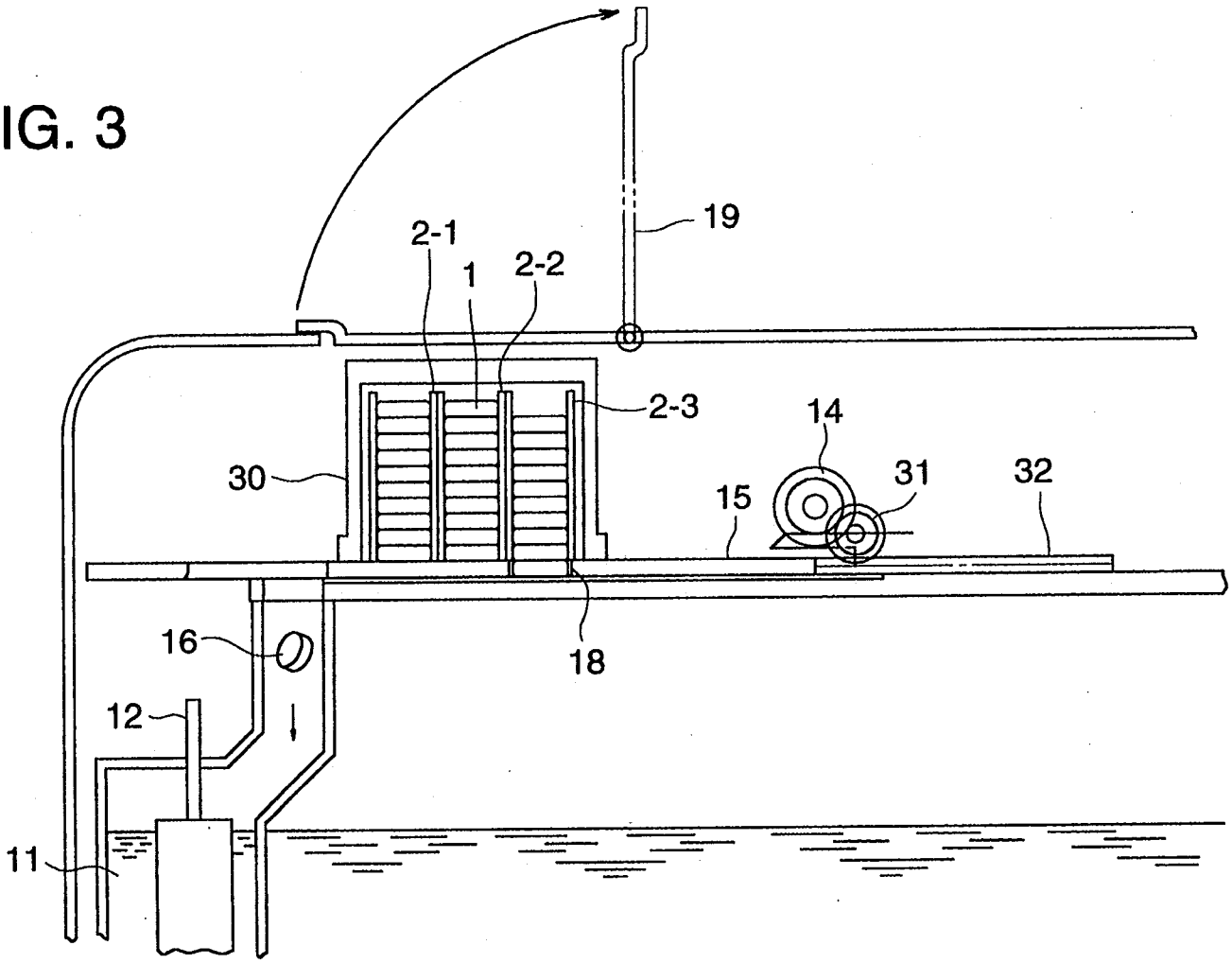
FIG. 3: A constitutional illustration showing another type of solid processing chemical putting-in device.

FIGS. 2, 3 and 4 are each a structural illustration of an example of the above-mentioned solid processing chemical replenishment or putting-in devices 2A, 2B, 2C and 2D respectively. In FIG. 3, dissolution chamber 11 for putting-in solid processing composition 1 is provided to the side of stabilizing tank 1D.

While dissolving the solid processing composition in dissolution chamber 11 in FIG. 3, the liquid concentration in the processing tank is controlled through filter 12 provided to the inside of the processing tank. Further, films to be processed inside an automatic processor were detected in number through a processing quantity information detection means. The detected information is sent to a processing quantity supply control means, so that motor 14 is so controlled as to start or to stop in motion by the above-mentioned processing quantity supply control means. In other words, when a processing quantity reached a certain level and a processing liquid concentration is deteriorated, motor 14 is started in rotation and sliding plate 15 is moved by gear 31 and extruding plate 32. Then, solid processing composition 16 is accepted by tablet-moving aperture 18 from the above-mentioned solid processing composition storage cylinders 2-1, 2-2 and 2-3 in storage case 30, so that the tablet was supplied to the dissolution chamber 11. In the figure, reference number 30 was a solid processing chemical storage case. In FIG. 2, the solid processing composition storage cylinders were provided by 3 units, 23-1, 23-2 and 23-3; and reference number 14 is a motor, 21 is a rotary table, 20 is a tablet transporting pocked, 22 is a tablet dropping outlet, and 24 is a solid processing composition, respectively.

In FIG. 3, solid processing chemical storage cylinders 2-1, -2 and -3 are each provided either in the system where the whole cylinder can be replaced at a time by opening top lid 19 when completing a series of supplies, or in the system where the cylinders are replaced one after another.

Now, the processing steps will be detailed below.

| Processing step | Processing time | Processing temp. |
|---|---|---|
| Color developing | 3 min. 15 sec. | 38.0° C. |
| Bleaching | 45 sec. | 38.0° C. |
| Fixing-1 | 45 sec. | 38.0° C. |
| Fixing-2 | 45 sec. | 38.0° C. |
| Stabilizing-1 | 20 sec. | 38.0° C. |
| Stabilizing-2 | 20 sec. | 38.0° C. |
| Stabilizing-3 | 20 sec. | 38.0° C. |
| Drying | 80 sec. | 55° C. |

The fixing steps were in a counter-current system from step-2 to step-1, and the stabilizing steps were of the same system except from step 3 to step 2 and then from step 2 to step 1. In the bleaching tank, an aeration was carried out by making use of an air-pump.

When a thermostatic control was carried out, a evaporation compensation was carried out in such a program that an evaporation was compensated by replenishing water in the amounts of 10 ml, 6.5 ml, 7 ml, 7 ml, 8.6 ml, 8.6 ml and 9.3 ml per hour to the color developing tank, bleaching tank, fixing tank-1, fixing tank-2, stabilizing tank-1, stabilizing tank-2 and stabilizing tank-3, respectively. In a non-operation state, a non-operation period was integrated and an evaporation was compensated by collectively replenishing water, when starting an operation, in the amounts of 7.5 ml, 5 ml, 6 ml, 6 ml, 5 ml, 5 ml and 5 ml each per hour to the color developing tank, bleaching tank, fixing tank-1, fixing tank-2, stabilizing tank-1, stabilizing tank-2 and stabilizing tank-3, respectively. The tank solutions for starting a processing treatment were prepared by making use of a replenishing liquid for Konica Color Negative Film Processing Chemical CNK-4-52 and a starter.

Next, the following color negative processing chemicals were prepared, respectively.

(1—1) Processing composition of a color development replenisher for color negative use 1) Color developer replenishing tablet for color negative film use Procedure (8)

A developing agent, that was 60 g of CD-4 [4-amino-3-methyl-N-ethyl-β-(hydroxy)ethylaniline sulfate], was pulverized up to have an average particle size of 10 μm in a hammer mill available on the market. The resulting fine powder thereof was granulated by adding 10 ml of water by taking about 7 minutes at room temperature in a mixing granulating machine available on the market. Then, the resulting granules were dried at 40° C. for 2 hours by making use of a fluid-bed type dryer so that the moisture of the granules could almost completely be removed. Thereby, granules (8) of a color developer replenisher composition for color negative use were prepared.

Procedure (9)

After pulverizing 69.4 g of hydroxylamine sulfate and 4 g of Pine-Flow (manufactured by Matsutani Chemical Co.) in the same manner as in procedure (1), they were mixed up and granulated. After granulating them upon adding water thereto in an amount of 3.5 ml, they were dried at 60° C. for 30 minutes so as to almost completely remove the moisture content of the granules. Thereby, granules (9) of a color developer replenisher composition for color negative use were prepared.

Procedure (10)

After pulverizing and then, mixed up 15 g of disodium 1-hydroxyethane-1,1-diphosphonate, 72.8 g of potassium sulfite, 350 g of potassium carbonate, 3 g of sodium hydrogencarbonate, 3.7 g of sodium bromide, 22 g of mannitol and 5.0 g of polyethylene glycol 6000 in the same manners as in procedures (1) and (2), water was added thereto in an amount of 40 ml so as to granulate them. After completing the granulation, the resulting granules were dried at 70° C. for 60 minutes so as to almost completely remove the moisture content of the granules. Thereby, granules (10) of a color developer replenisher composition for color negative use was prepared.

The resulting granules (8) through (10) of color developer replenishers compositions for color negative use were mixed together. The resulting granules were added by 2 g of sodium N-myristoyl alanine and then uniformly mixed up in a room being kept at 25° C. and being rehumidified to be not higher than 40%RH, by making use of a mixer for 10 minutes. Then, the resulting mixture was compression-tableted, with a filling amount of 10 g per tablet, by making use of a remodeled Tough-Pressed Collect 1527HU tableting machine manufactured by Kikusui Mfg., Co. Thereby, the tablets having a tablet size of 30 mm were prepared as color developer replenishers for color negative use.

2) Tablet serving as a bleaching replenisher for color negative use

Procedure (11)

After pulverizing 237 g of ferric potassium 1,3-propanediamine tetraacetate, 70 g of succinic acid and 10 g of 1,3-propanediaminetetraacetic acid in the same manners as in procedures (1) and (2), they were granulated. After granulating them upon spraying water thereto in an amount of 5 ml, the resulting granules were dried at 60° C. for 7 minutes. Then, the granules were dried in a vacuum at 40° C. for 2 hours, so as to almost completely remove the moisture content thereof.

Procedure (12)

After pulverizing 90 g of potassium bromide, 104 g of potassium carbonate and 100 g of succinic acid in the same manners as in procedures (1) and (2), they were granulated. After granulating upon spraying water in an amount of 1.0 ml, the resulting granules were dried at 70° C. for 3 minutes. Then, the granules were dried in a vacuum at 40° C. for 120 minutes, so as to almost completely remove the moisture content thereof.

Procedure (13)

The granules prepared in the above-mentioned procedures (11) and (12) were uniformly mixed up for 10 minutes in a room so rehumidified as to be not higher than 40%RH at 25° C., by making use of a mixer. Then, the resulting mixture was compression-tableted, with a filling amount of 10.0 g per tablet, by making use of a remodeled Tough-Pressed Collect 1527HU tableting machine manufactured by Kikusui Mfg., Co. Thereby, 80 pieces of tablets were prepared as bleaching replenishers for composition color negative use.

3) Tablet serving as a fixer replenisher for color negative use

Procedure (14)

After pulverizing 950 g of potassium thiosulfate, 2020 g of sodium thiocyanate, 120 g of sodium sulfite, 150 g of potassium carbonate and 10 g of disodium ethylenediamine tetraacetate in the same manners as in procedures (1) and (2), they were granulated. After granulating upon spraying water in an amount of 30.0 ml, the resulting granules were dried at 65° C. for 60 minutes. Then, the granules were dried in a vacuum at 40° C. for 480 minutes, so as to almost completely remove the moisture content thereof.

Procedure (15)

The granules prepared in the above-mentioned procedure (15) were uniformly mixed up by making use of a mixer for 10 minutes in a room so rehumidified as to be not higher than 40%RH at 25° C. Then, the resulting mixture was compression-tableted, with a filling amount of 10.0 g per tablet, by making use of a remodeled Tough-Pressed Collect 1527HU tableting machine manufactured by Kikusui Mfg., Co. Thereby, 2000 pieces of tablets were prepared as fixer replenishers for color negative use.

4) Tablet serving as a stabilizer replenisher for color negative use

The same tablets shown in Table 3 were used for.

By repeating the above-mentioned procedures, the processing tablets were prepared respectively in the numbers required for trying the following running tests.

While an automatic processor was under thermostatic control, 20 pieces each of the replenishing tablets prepared in the above-mentioned procedures were set on a replenishing tablet supply device provided to the automatic processor. When 7.1 rolls of 135-sized 20-exposure roll films were processed by a tablet for a developer replenisher; 3.6 rolls thereof, by a tablet for a bleaching replenisher; 1.2 rolls thereof, by a tablet for a fixer replenisher; and 125 rolls thereof, by a tablet for a stabilizer replenisher; one each of the succeeding tablets were put into the filter tanks, respectively.

Further, when two rolls of 135-sized 20-exposure film were processed, replenishing warm-water was so arranged as to be supplied in an amount of 40 ml to a color developing tank, 10 ml to a bleaching tank, 40 ml to a fixing tank and 80 ml to a stabilizing tank, respectively, from a warm-water supply device.

Color negative film, DD-100 (manufactured by Konica Corp.), was used for a light-sensitive material subject to the tests.

The light-sensitive material samples were exposed wedgewise in an ordinary method and were then running-processed in the aforementioned processing steps; provided that the running-process was continuously carried out until a replenishment amount of the bleaching solution was made double or 2 round the bleaching tank capacity.

After completing the running-processing, each of the following observation was made inside the stabilizing tank in which the above-mentioned imagewise exposed films were processed; A sulfrized precipitation, a tar production, a coherer to the tank wall, and a contamination and scratch on the subject running-processed film sample and a foreign matter adhered thereto. And, the measurements were made on the magenta density in the maximum density portion and the yellow density in the minimum density portion each of the subject film sample. After preserving the samples for 10 days in such a state as at 70° C. and 25%RH, the maximum densities of magenta and yellow were each measured so that the dye color-fading ratio and dye increasing ratio were obtained. The results thereof will be given in Table 3.

The evaluation criteria were determined as follows.

[Evaluation criteria]

(1) On sulfrized precipitation

A: Not precipitated at all;

B: Not precipitated on the liquid surface, but a suspended matter confirmed, that will sometimes be practically problematical;

C: Suspended matter & precipitate confirmed; and

D: Suspended matter & precipitate each cohered to a rack wall on the liquid-level;

(2) Production of tar

A: Not produced at all;

B: Slightly produced, that will sometimes be practically problematical; and

C: Many produced.

(3) Cohesion matter

A: Not cohered at all;

B: Slightly cohered, but no problem as a commercial article;

C: Unfit for a commercial article; and

D: Incompetent for any commercial article at all.

(4) Rear-surface contamination after processing

A: No contamination produced at all;

B: Slightly contaminated, but no problem as a commercial article; and

C: Unfit for a commercial article.

TABLE 5

| Test No. | Solid stabilizing chemical | Magenta fading ratio (%) | Yellow increasing ratio (%) | Sulfrized precipitation | Tar production | Cohesion | Rear contamination after processing | Remarks |
|---|---|---|---|---|---|---|---|---|
| 5-1 | A-1 was used (ref. to Table 1) | 21.3 | 7.1 | C | C | C | C | Comparison |
| 5-2 | A-2 was used (ref. to Table 1) | 19.8 | 6.8 | C | C | C | C | Comparison |
| 5-3 | A-3 was used (ref. to Table 1) | 20.1 | 6.2 | C | B | C | C | Comparison |
| 5-4 | B-1 was used (ref. to Table 1) | 11.2 | 5.4 | B | B | C | B | Comparison |
| 5-5 | B-2 was used (ref. to Table 1) | 13.6 | 5.5 | B | B | B | A | Comparison |
| 5-6 | B-3 was used (ref. to Table 1) | 12.7 | 6.0 | B | A | B | A | Comparison |
| 5-7 | C-1 was used (ref. to Table 1) | 26.7 | 9.0 | D | B | C | C | Comparison |
| 5-8 | C-2 was used (ref. to Table 1) | 27.7 | 10.4 | D | B | D | C | Comparison |
| 5-9 | C-3 was used (ref. to Table 1) | 26.5 | 9.8 | D | B | C | C | Comparison |
| 5-10 | D-1 was used (ref. to Table 1) | 3.0 | 0.1 | B | A | B | A | Invention |
| 5-11 | D-2 was used (ref. to Table 1) | 4.0 | 0.2 | A | A | A | A | Invention |
| 5-12 | D-3 was used (ref. to Table 1) | 3.7 | 0 | A | A | A | A | Invention |
| 5-13 | E-1 was used (ref. to Table 1) | 2.1 | 0 | A | A | A | A | Invention |
| 5-14 | E-2 was used (ref. to Table 1) | 1.8 | 0 | A | A | A | A | Invention |
| 5-15 | E-3 was used (ref. to Table 1) | 2.0 | 0 | A | A | A | A | Invention |
| 5-16 | F-1 was used (ref. to Table 1) | 3.0 | 0.1 | B | A | B | A | Invention |
| 5-17 | F-2 was used (ref. to Table 1) | 4.1 | 0 | A | A | A | A | Invention |
| 5-18 | F-3 was used (ref. to Table 1) | 4.2 | 0 | A | A | A | A | Invention |
| 5-19 | G-1 was used (ref. to Table 1) | 4.2 | 0 | B | A | B | A | Invention |
| 5-20 | G-2 was used (ref. to Table 1) | 3.7 | 0 | B | A | B | A | Invention |
| 5-21 | G-3 was used (ref. to Table 1) | 3.8 | 0 | A | A | A | A | Invention |
| 5-22 | H-1 was used (ref. to Table 1) | 4.2 | 0.1 | B | A | B | A | Comparison |
| 5-23 | H-2 was used (ref. to Table 1) | 4.0 | 0 | B | A | B | A | Comparison |
| 5-24 | H-3 was used (ref. to Table 1) | 4.5 | 0 | A | A | A | A | Comparison |
| 5-25 | J-1 was used (ref. to Table 1) | 4.3 | 0.1 | B | A | A | A | Invention |
| 5-26 | J-2 was used (ref. to Table 1) | 2.0 | 0.1 | B | A | A | A | Invention |
| 5-27 | J-3 was used (ref. to Table 1) | 3.0 | 0 | A | A | B | A | Invention |

Example 6

Ten tablets for stabilizer replenishment used in Example 5 (described in Table 5) were dissolved in 50 l of water so that a replenisher for stabilizer was prepared. After that, a pump was provided and 2 round-continuous processing was conducted in the same manner as in Example 5 except that 80 ml is replenished every time 2 rolls of 135 size film with 24 exposures are processed. As a result, almost the same results were obtained as in Example 5.

What is claimed is:

1. A composition of stabilizer for processing silver halide photographic material comprising a fluorinated anionic surfactant represented by Formula I;

$$Rf\text{-}(X)_m\text{-}(Y)_n\text{-}A \quad (I)$$

wherein Rf is an alkyl group having a fluorine atom, an alkenyl group having a fluorine atom or an alkinyl group having a fluorine atom; X is a sulfonamido group, a

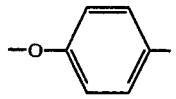

group or a

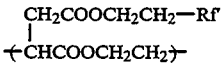

group, in which Rf' is a saturated or unsaturated hydrocarbon group having a fluorine atom; Y is alkyleneoxide or alkylene; A is an $-SO_3M$ group, an $-OSO_3M$ group, a —COOM group, an $-OPO_3(M_1)(M_2)$ group or a $-PO_3(M_1)(M_2)$ group, in which M, $M_1$ and $M_2$ are each a hydrogen atom, a lithium atom, a potassium atom, a sodium atom or an ammonium group; m is 0 or 1 and n is 0 or an integer of 1 to 10.

2. The composition of claim 1, wherein said composition further comprises a formalin substitution compound represented by formula F, G, K-1, K-2 or K-3, or a hexamethylenetetramine compound;

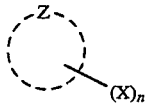

(F)

wherein Z is a group of atoms necessary to form a carbon ring or a heterocyclic ring; and X is an aldehyde group, a

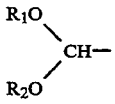

group or a

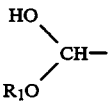

group; $R_1$ and $R_2$ are each an alkyl group having 1 to 5 carbon atoms; and n is an integer of 1 to 4,

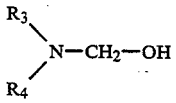

(G)

wherein $R_3$ and $R_4$ are each independently a hydrogen atom or a substituent, $R_3$ and $R_4$ may be linked to form a ring including one or two nitrogen atoms,

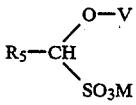

(K-1)

$$W\text{-}O\text{-}(CH_2O)_n\text{-}Y \quad (K\text{-}2)$$

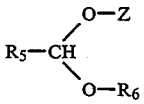

(K-3)

wherein $R_5$ is a hydrogen atom or an aliphatic hydrocarbon group; V is a group capable of releasing by hydrolysis; M is a cation; W and Y are each independently a hydrogen atom or a group capable of releasing by hydrolysis; n is an integer of 1 to 10; Z is a hydrogen atom, an aliphatic hydrocarbon group, an aryl group or a group capable of releasing by hydrolysis; and $R^6$ is an aliphatic hydrocarbon group or an aryl group; Z and $R_6$ may be linked to form a ring.

3. The composition of claim 1, wherein said composition has a solid form.

4. The composition of claim 3, wherein said composition has a form of a granule or a tablet.

5. The composition of claim 4, wherein said composition in a form of tablet has a bulk-density of 1.0 g/cm$^3$ to 2.5 g/cm$^3$.

6. The composition of claim 4, wherein said composition in a form of granule has a bulk-density of 0.4 g/cm$^3$ to 1.7 g/cm$^3$.

7. The composition of claim 3, wherein said solid composition has a water content of 0.1 to 15% by weight.

8. A method for processing a silver halide photographic light-sensitive material comprising the step of stabilizing said light-sensitive material with a stabilizer composition comprising a fluorinated anionic surfactant represented by Formula I;

$$Rf\text{-}(X)_m\text{-}(Y)_n\text{-}A \quad (I)$$

wherein Rf is an alkyl group having a fluorine atom, an alkenyl group having a fluorine atom or an alkinyl group having a fluorine atom; X is a sulfonamido group, a

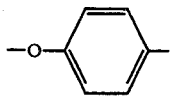

group or a

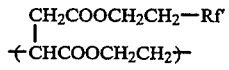

group, in which Rf' is a saturated or unsaturated hydrocarbon group having a fluorine atom; Y is alkyleneoxide or alkylene; A is an $—SO_3M$ group, an $—OSO_3M$ group, a —COOM group, an $—OPO_3(M_1)(M_2)$ group or a $—PO_3(M_1)(M_2)$ group, in which M, $M_1$ and $M_2$ are each a hydrogen atom, a lithium atom, a potassium atom, a sodium atom or an ammonium group; m is 0 or 1 and n is 0 or an integer of 1 to 10.

9. The method of claim 8, wherein said stabilizer composition further comprises a formalin substitution compound represented by formula F, G, K-1, K-2, or K-3 or a hexamethylenetetramine compound;

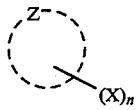

(F)

wherein z is a group of atoms necessary to form a carbon ring or a heterocyclic ring; and X is an aldehyde group, a

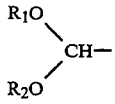

group or a

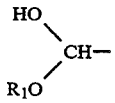

group; $R_1$ and $R_2$ are each an alkyl group having 1 to 5 carbon atoms; and n is an integer of 1 to 4,

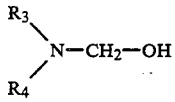

(G)

wherein $R_3$ and $R_4$ are each independently a hydrogen atom or a substituent, $R_3$ and $R_4$ may be linked to form a ring including one or two nitrogen atoms,

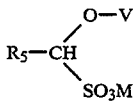

(K-1)

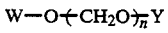

(K-2)

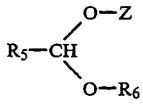

(K-3)

wherein $R_5$ is a hydrogen atom or an aliphatic hydrocarbon group; V is a group capable of releasing by hydrolysis; M is a cation; W and Y are each independently a hydrogen atom or a group capable of releasing by hydrolysis; n is an integer of 1 to 10; Z is a hydrogen atom, an aliphatic hydrocarbon group, an aryl group or a group capable of releasing by hydrolysis; and $R^6$ is an aliphatic hydrocarbon group or an aryl group; Z and $R_6$ may be linked to form a ring.

10. The method of claim 8, wherein said composition has a solid form.

11. The method of claim 10, wherein said composition has a form of a granule or a tablet.

12. The method of claim 11, wherein said composition in a form of tablet has a bulk-density of 1.0 g/cm$^3$ to 2.5 g/cm$^3$.

13. The composition of claim 11, wherein said composition in a form of granule has a bulk-density of 0.4 g/cm$^3$ to 1.7 g/cm$^3$.

14. The method of claim 10, wherein said solid composition has a water content of 0.1 to 15% by weight.

15. The method of claim 10, wherein said solid stabilizer composition is substantially applied to a stabilizing tank of an automatic processor.

16. The method of claim 15, wherein water is substantially applied to a stabilizing tank of an automatic processor.

* * * * *